US009603451B2

(12) United States Patent
Masunaga et al.

(10) Patent No.: US 9,603,451 B2
(45) Date of Patent: Mar. 28, 2017

(54) HEIGHT ADJUSTMENT DEVICE IN FIXTURE, AND ARMREST DEVICE FOR CHAIR PROVIDED WITH HEIGHT ADJUSTMENT DEVICE

(71) Applicant: OKAMURA CORPORATION, Kanagawa (JP)

(72) Inventors: Hiroshi Masunaga, Kanagawa (JP); Yuuichirou Takagi, Kanagawa (JP); Youichirou Oda, Kanagawa (JP); Alexander Hurford, Kanagawa (JP)

(73) Assignee: OKAMURA CORPORATION, Kanagawa (JP)

( * ) Notice: Subject to any disclaimer, the term of this patent is extended or adjusted under 35 U.S.C. 154(b) by 25 days.

(21) Appl. No.: 14/398,122

(22) PCT Filed: May 2, 2013

(86) PCT No.: PCT/JP2013/062761

§ 371 (c)(1),
(2) Date: Oct. 30, 2014

(87) PCT Pub. No.: WO2013/165017

PCT Pub. Date: Nov. 7, 2013

(65) Prior Publication Data

US 2015/0130250 A1 May 14, 2015

(30) Foreign Application Priority Data

May 2, 2012 (JP) ..... 2012-105234
Oct. 19, 2012 (JP) ..... 2012-232059

(51) Int. Cl.
*A47C 1/03* (2006.01)
*A47C 7/54* (2006.01)

(52) U.S. Cl.
CPC . *A47C 1/03* (2013.01); *A47C 7/54* (2013.01)

(58) Field of Classification Search
CPC ..... A47C 7/54; A47C 1/03
(Continued)

(56) References Cited

U.S. PATENT DOCUMENTS 431,803 A * 7/1890 Cunningham ..... A47C 3/26 248/408
1,070,278 A * 8/1913 McKinney ..... B60N 2/505 248/160

(Continued)

FOREIGN PATENT DOCUMENTS

CN 2368368 Y 3/2000
CN 2484846 Y 4/2002

(Continued)

OTHER PUBLICATIONS

International Search Report for PCT Application No. PCT/JP2013/0622761 dated Jun. 4, 2013.

(Continued)

*Primary Examiner* — Milton Nelson, Jr.
(74) *Attorney, Agent, or Firm* — Nixon Peabody, LLP; Khaled Shami

(57) ABSTRACT

An armrest device for a chair includes a lower support rod that rises at a side of a chair seat and has a tubular upper end portion; and an upper support cylinder that has an armrest provided in an upper end thereof, is externally fitted to the lower support rod so as to be slidable in an up-down direction, and has a plurality of engaging portions therein. The armrest is made height-adjustable with respect to the lower support rod by disposing the locking member and a biasing member at an upper end portion of the lower support rod and providing the rotating rod inside the lower support rod.

8 Claims, 23 Drawing Sheets

(58) Field of Classification Search
USPC ..... 297/411.36; 248/408, 118.3
See application file for complete search history.

(56) References Cited

U.S. PATENT DOCUMENTS

| | | | | |
|---|---|---|---|---|
| 4,546,668 | A | 10/1985 | Mattsson | |
| 5,265,938 | A | 11/1993 | Melhuish et al. | |
| 5,599,067 | A | 2/1997 | Schuelke et al. | |
| 6,336,680 | B1 | 1/2002 | Lee | |
| 6,540,300 | B2 | 4/2003 | Piretti | |
| 7,011,371 | B1 | 3/2006 | Tsai | |
| 7,556,316 | B1 | 7/2009 | Lai | |
| 7,661,763 | B2 * | 2/2010 | Tsai | A47C 1/03 297/411.36 |
| 2003/0214171 | A1 | 11/2003 | Burwell et al. | |
| 2005/0225149 | A1 * | 10/2005 | Wang | A47C 1/03 297/411.36 |
| 2006/0226691 | A1 | 10/2006 | Bedford et al. | |
| 2007/0093129 | A1 * | 4/2007 | Ho | A47C 1/03 439/579 |
| 2008/0224526 | A1 | 9/2008 | Tsai | |
| 2010/0066147 | A1 * | 3/2010 | Tsai | A47C 1/03 297/411.36 |

FOREIGN PATENT DOCUMENTS

| | | | |
|---|---|---|---|
| CN | 1671317 | A | 9/2005 |
| JP | 09-173178 | | 7/1997 |
| JP | 10-099161 | A | 4/1998 |
| JP | 2007-044130 | A | 2/2007 |
| JP | 2007-190221 | A | 8/2007 |
| JP | 2008-535565 | A | 9/2008 |

OTHER PUBLICATIONS

Supplementary European Search Report issued in EP Patent Application No. 13784408.0 dated Jan. 12, 2015, 8 pages.
Search Report, dated Mar. 25, 2016, issued in Chinese Patent Application No. 2013800229122, 9 pages.

* cited by examiner

HEIGHT ADJUSTMENT DEVICE IN FIXTURE, AND ARMREST DEVICE FOR CHAIR PROVIDED WITH HEIGHT ADJUSTMENT DEVICE

CROSS-REFERENCE TO RELATED PATENT APPLICATIONS

This is the U.S. National Phase Application under 35 U.S.C. §371 of International Patent Application No. PCT/JP2013/062761 filed May 2, 2013, which designated the United States and was published in a language other than English, which claims the benefit of Japanese Patent Application No. 2012-105234filed on May 2, 2012, and Japanese Patent Application No. 2012-232059 filed on Oct. 19, 2012, all of them are incorporated by reference herein. The International Application was published in Japanese on Nov. 7, 2013 as WO2013/165017 A1 under PCT Article 21(2).

BACKGROUND OF THE INVENTION

The present invention relates to a height adjustment device in a fixture, and an armrest device for a chair provided with the height adjustment device.

BACKGROUND ART

There are the following types of devices (A) to (C) in height adjustment devices in related-art armrest devices for a chair.

(A) A device in which an upper support cylinder having an armrest provided at an upper end thereof is externally fitted to a tubular lower support rod rising at a side of a chair seat so as to be slidable in an up-down direction, a plurality of engaging portions are provided side by side in the up-down direction in an inner surface of the lower support rod, and a pin or a claw adapted to be selectively engaged with the plurality of engaging portions is moved by an extension portion or a lever body of an operating lever provided in the upper support cylinder (for example, refer to Patent Document 1 to 3).

(B) A device in which a plurality of engaging portions are provided side by side in an up-down direction in an outer surface of a lower support rod, and a claw of an operating lever provided on an upper support cylinder is selectively engaged with the plurality of engaging portions (for example, refer to Patent Document 4).

(C) A device in which a plurality of engaging portions are provided side by side in an up-down direction in an extension portion of an operating lever, and a pin provided so as to protrude from an inner surface of a lower support rod is adapted to be selectively engaged with the plurality of engaging portions (for example, refer to Patent Document 5).

CITATION LIST

Patent Document

[Patent Document 1] Japanese Unexamined Patent Application, First Publication No. H9-173178

[Patent Document 2] Japanese Unexamined Patent Application, First Publication No. 2007-190221

[Patent Document 3] Specification of U.S. Pat. No. 5,265,938

[Patent Document 4] Japanese Unexamined Patent Application, First Publication No. H10-99161

[Patent Document 5] Specification of U.S. Pat. No. 6,540,300

SUMMARY OF INVENTION

Technical Problem

In the above types of devices (A) to (C), the extension portion of the operating lever should be formed so as to be elongated downward from a portion for pivotal attachment to the upper support cylinder, the rotation radius of a tip of the extension portion becomes large, and the tip of the extension portion is greatly rotated by the slight rotation of the operating lever. Thus, it is difficult to precisely transmit the operation of the operating lever to the tip of the extension portion, and the possibility of erroneous operation and a malfunction is high.

Particularly, in the type of device (C), the engagement depth or disengagement distance between the plurality of engaging portions provided in the extension portion of the operating lever and the pin becomes significantly smaller in an engaging portion near the pivotal attachment portion than in an engaging portion near the tip of the extension portion. As a result, a required rotational angle, a required operating force, or the like of the operating lever at the time of locking and unlocking fluctuates depending on the height of the armrest, and the operability is bad.

In the above type of device (B), if the movement stroke of the movable member in the up-down direction is made large, the plurality of engaging portions are exposed to the outside, and become unseemly.

In order to keep the engaging portions from being exposed to the outside, the length of the upper support cylinder in the up-down direction should be made large, the length of the lower support rod in the up-down direction should also be made large with this. As a result, the whole armrest is enlarged and material costs are increased.

If the length of the up-down direction of the whole armrest is made large, the attachment position of the lower support rod to a main body of the chair is markedly low. As a result, an attachment region is limited, and the armrest is too conspicuous from a design point of view.

For that purpose, it is preferable to keep the length of the whole armrest in the up-down direction from being large even if the movement stroke is made large.

Additionally, in all the above (A), (B), and (C), the armrest is lifted and lowered along a linear track. However, in the case of a design in which the lower support rod and the upper support cylinder are curved, the armrest is lifted and lowered in a curved track along the lower support rod and the upper support cylinder. In this case, deviation is considered to occur in the engagement relationship between the extension portion or the lever body of the operating lever provided at the upper support cylinder and the engaging portion provided at the lower support rod, and poor operation is caused.

The invention has been made in view of the above-described circumstances in the related-art, and provides a height adjustment device in a fixture and an armrest device for a chair provided with the height adjustment device aimed at keeping a plurality of engaging portions from being exposed to the outside even if the movement stroke of a movable member is made large, making an operation smooth using an operating lever provided at the movable member irrespective of the up-down position or lifting and lowering track of the movable member, and always lightly performing locking and unlocking operations in the same manner irrespective of the up-down position of the movable member, having little possibility of erroneous operation or malfunction.

Solution to Problem

A first aspect related to a height adjustment device in a fixture of the present invention includes a support; a movable member that is mounted on the support so as to be movable in an up-down direction, has a plurality of engaging portions arranged side by side in the up-down direction therein, and extends in the up-down direction; a locking member that is provided in the support so as to be movable in a horizontal direction and immovable in the up-down direction to a locking position where the locking member is selectively engaged with any one engaging portion of the movable member and to an unlocking position where the locking member is disengaged from the engaging portion; biasing member that is provided at the support and biases the locking member toward the locking position; an actuating member that is provided at the movable member, is made movable in the up-down direction with respect to the support and the locking member together with the movable member, keeps an action portion, which is slidable up and down with respect to the locking member, engaged with the locking member even if being moved in the up-down direction, and makes the locking member movable in a direction of the unlocking position at any up-down position; and an operating member that is provided at the movable member and actuates the actuating member so as to move the locking member in the direction of the unlocking position via the actuating member.

According to such a configuration, the locking member provided at the support is selectively engaged with the plurality of engaging portions provided inside the movable member. Accordingly, the movable member can be held at an arbitrary height, the plurality of engaging portions are not exposed to the outside even if the movement stroke of the movable member is made large, and the appearance of a fixture to which the device is applied is improved.

The movable member is made liftable by actuating the actuating member with the operating lever provided at the movable member and moving the locking member provided at the support from the locking position to the unlocking position. By leaving a hand from the operating lever after the movable member is adjusted to an arbitrary height, the locking member is pushed from the unlocking position to the locking position with the biasing force of the biasing member, and is engaged with any one of the plurality of engaging portions of the movable member to lock the movable member at that height.

The actuating member keeps the action portion, which is slidable up and down with respect to the locking member, engaged with the locking member at any up-down position where the actuating member is lifted and lowered together with the movable member, and an operation using the operating lever can always be performed irrespective of the up-down position of the movable member. Although the actuating member and the locking member are distributed and provided in the support and the movable member, the engagement relationship between these actuating member and locking member is kept equal irrespective of the up-down position of the movable member, the interlocking operation of these actuating member and locking member is kept excellent, and the operation using the operating lever provided at the movable member is made smooth.

A second aspect related to a height adjustment device in a fixture of the present invention includes a support; a movable member that is mounted on the support so as to be movable in an up-down direction, has a plurality of engaging portions arranged side by side in the up-down direction, and extends in the up-down direction; a locking member that is provided at the support so as to be movable in a horizontal direction and immovable in the up-down direction to a locking position where the locking member is selectively engaged with any one engaging portion of the movable member and to an unlocking position where the locking member is disengaged from the engaging portion; biasing member that is provided at the support and biases the locking member toward the locking position; a rotating rod that is parallel to the movable member, is mounted on the movable member so as to be rotatable around an axis extending in the up-down direction, and is movable in the up-down direction together with the movable member with respect to the support and the locking member; an interlocking mechanism that interlocks the rotating rod and the locking member so that the locking member is moved in a direction of the unlocking position by the rotation of the rotating rod in one direction; and an operating lever that is provided in the movable member and rotates the rotating rod around the axis extending in the up-down direction.

According to such a configuration, if the rotating rod is rotated around the axis directed to the up-down direction by the operating lever provided at the movable member, the locking member is moved to the unlocking position against the biasing force of the biasing member via the interlocking mechanism, and the locking member is disengaged from the engaging portion of the movable member. Thus, the movable member can be moved to an arbitrary height.

If a hand is left from the operating lever in a state where the movable member is held at an arbitrary height, the locking member is pushed to the locking position with the biasing force of the biasing member, and is engaged with any one of the plurality of engaging portions of the movable member to lock the movable member at that height. If the locking member is not engaged with any engaging portion, the locking member can be engaged with any engaging portion by slightly moving the movable member up and down.

The rotating rod only moves in the up-down direction with respect to the locking member together with the movable member, and the relationship among the rotating rod, the locking member, and the interlocking mechanism does not fluctuate at all. Thus, regardless of the height at which the movable member is located, locking and unlocking operations can always be lightly performed under the same conditions.

Moreover, since the relationship among the rotating rod, the locking member, and the interlocking mechanism do not fluctuate, the possibility of an erroneous operation and a malfunction can be reduced.

In a third aspect of the height adjustment device in a fixture of the present invention based on the second aspect, the rotating rod is rotatably inserted through an insertion hole provided in the locking member and directed to the up-down direction. The interlocking mechanism includes a protrusion that is provided so as to protrude from an inner surface of the insertion hole of the locking member, and a recessed groove that is provided in an outer peripheral surface of the rotating rod, has the protrusion fitted thereinto in a relatively movable manner, and is directed to the up-down direction. The rotating rod is rotated in one direction around the axis, and thereby the protrusion is pushed by an actuating portion formed on one side surface of the recessed groove, and the locking member is moved toward the unlocking position.

According to such a configuration, the interlocking mechanism can be a simple structure including the protrusion provided on the locking member and the recessed groove provided in the rotating rod.

Additionally, even if the height of the movable member fluctuates, the up-down position of the actuating portion of the rotating rod that abuts against the protrusion of the locking member only fluctuates, and the distance from the rotation center of the rotating rod to a point of abutment against the protrusion of the locking member do not fluctuate. Thus, even if the movable member is located at any height, an operating force that moves the locking member to the unlocking position does not fluctuate, and locking and unlocking operations can always be lightly performed under the same conditions.

In a fourth aspect related to the height adjustment device in a fixture of the present invention based on the second or third aspect, an abutting surface parallel to a central axis of the rotating rod is formed in portion of the rotating rod, and the rotating rod is rotated by pushing the eccentric portion of the abutting surface with one end portion of the operating lever provided at the movable member.

According to such a configuration, the rotating rod can be rotated with a weak force by the operating lever, any type out of a rotary type in which the operating lever is pivotally attached to the movable member with the pivot and an extend/retract type in which the operating lever, for example, makes a linear motion in the frontward-rearward direction can be adopted, and the degree of freedom of design is increased.

In a fifth aspect related to the height adjustment device in a fixture of the present invention based on any one of the above aspects, the locking member is tiltably supported on the support.

According to such a configuration, when the movable member is lifted and lowered in a curved track with respect to the support, the locking member is tiltably supported by the support even if the actuating member or the rotating rod is inclined with respect to the locking member. Accordingly, the engagement relationship between the actuating member or the action portion of the rotating rod and the locking member is kept equal irrespective of the up-down position of the movable member. That is, an operation using the operating lever provided at the movable member is made smooth irrespective of the up-down position and lifting and lowering track of the movable member.

In a sixth aspect related to the height adjustment device in a fixture of the present invention based on the fifth aspect, the locking member tilts around an axis of an engaging protrusion provided to protrude so as to be engaged with the engaging portion.

According to such a configuration, the engaging protrusion of the locking member can also be used as a tilt shaft of the locking member, and the structure of tilting the locking member can be simplified.

A seventh aspect related to the height adjustment device in a fixture of the present invention based on any one of the above aspects further includes a guide member that is fixed inside the movable member, has the plurality of engaging portions, and extends in the up-down direction.

According to such a configuration, compared to the case in which the inner wall of the movable member is directly formed with the plurality of engaging portions, the engaging portions are formed in the guide member that is a member separate from the movable member, and that is anchored inside the movable member. Accordingly, it is possible to mold the movable member simply by shaping it with a mold in the up-down direction, and a mold structure can be simplified.

In an eighth aspect related to the height adjustment device in a fixture of the present invention based on the seventh aspect, the guide member has a plurality of engaging holes as the plurality of engaging portions.

According to such a configuration, the guide member itself is arranged inside the movable member. Thus, the engaging holes can be prevented from being exposed to the outside even though the engaging portions are easily formed by the engaging holes.

In an armrest device for a chair, the support in the height adjustment device in a fixture according to any one of the above aspects serves as a lower support rod that rises at a side of a chair seat and has a tubular upper end portion, and the movable member serves as an upper support cylinder that has an armrest provided at an upper end thereof, is externally fitted to the lower support rod so as to be slidable in the up-down direction, and has a plurality of engaging portions therein. The armrest is made height-adjustable with respect to the lower support rod by disposing the locking member and the biasing member at an upper end portion of the lower support rod and inserting the actuating member or the rotating rod further inward than the upper end portion of the lower support rod.

According to such a configuration, it is possible to provide the armrest device for a chair that keeps the plurality of engaging portions from being exposed to the outside even if the movement stroke of the armrest is made large, makes an operation smooth using the operating lever provided at the upper support rod irrespective of the up-down position or lifting and lowering track of the armrest, and has little possibility of erroneous operation or malfunction.

Additionally, even if the movement stroke of the armrest is made large, it is not necessary to make the length of the whole armrest in the up-down direction large. Thus, miniaturization of the whole armrest device and reduction of material costs can be achieved, and the degree of freedom of the attachment position of the armrest device to the chair can be increased.

Advantageous Effects of Invention

According to the invention, there are provided the height adjustment device in a fixture and the armrest device for a chair provided with the height adjustment device aiming at keeping the plurality of engaging portions from being exposed to the outside even if the movement stroke of the movable member is made large, making smooth an operation using the operating lever provided at the movable member irrespective of the up-down position or lifting and lowering track of the movable member, always lightly performing locking and unlocking operations in the same manner irrespective of the up-down position of the movable member, and having little possibility of erroneous operation or malfunction.

DESCRIPTION OF EMBODIMENTS

<First Embodiment>

Hereinafter, a first embodiment of a chair in which a height adjustment device of the present invention is applied to an armrest device will be described with reference to the drawings.

Figure 1:
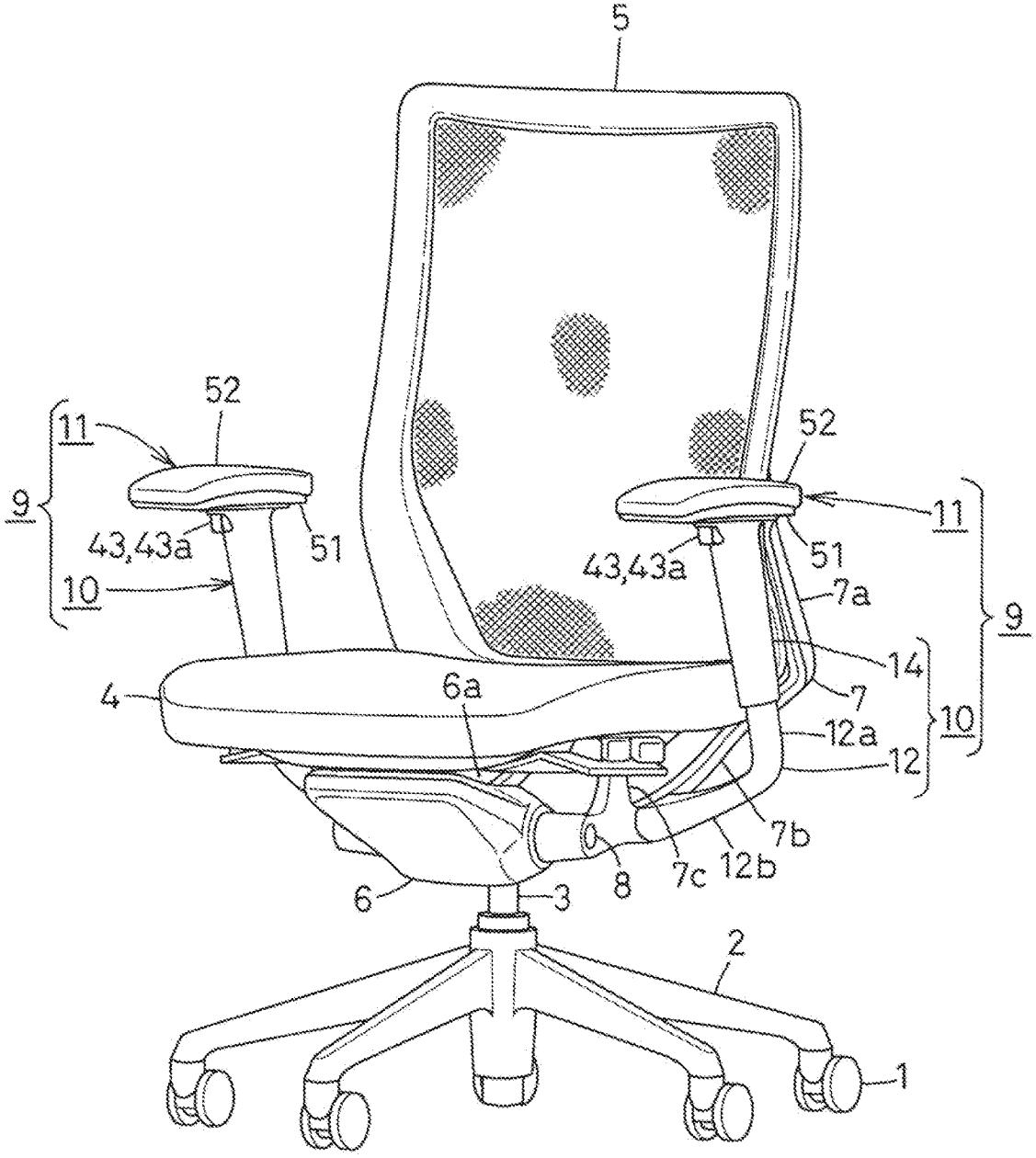
FIG. 1 is a perspective view of a chair in which a height adjustment device related to an embodiment of the present invention is applied to an armrest device.

As shown in FIG. 1, in this chair, a post 3 is erected at the center of five legs 2 that have casters 1 provided at their tips and extend radially, and a supporting base 6 that supports a seat 4 and a backrest 5 is provided at an upper end of the post 3.

The backrest 5 is supported by rising portions 7*a* of rear portions in a pair of left and right backrest supporting rods (only one of these rods is shown) 7 forming a substantial L-shape in a side view, and front end portions of forward portions 7*b* that are directed to the front from lower ends of the rising portions 7*a* in both the backrest supporting rods 7 are anchored to both end portions of a pivot 8 passing through the supporting base 6 in a left-right direction.

Biasing member (not shown) that biases the backrest supporting rod 7 in a direction in which the backrest 5 rises is provided via the pivot 8 within the supporting base 6.

An upper end portion of an upward protruding piece 7*c* provided at a portion slightly behind the pivot 8 in the forward portion 7*b* of the backrest supporting rod 7 is coupled to a rear lower portion of the seat 4 by a shaft (not shown) directed to the left-right direction.

A front lower portion of the seat 4 is mounted on the supporting base 6 so as to be able to slide in a frontward-rearward direction along a front portion upper surface 6*a* of the supporting base 6 that inclines rearward and downward.

Accordingly, as the backrest 5 tilts rearward, a rear portion of the seat 4 moves rearward and downward, and a front portion of the seat 4 moves rearward and frontward along the front portion upper surface 6*a* of the supporting base 6.

As shown in FIGS. 1 to 4, the armrest device 9 is provided at an intermediate portion of the forward portion 7*b* in the frontward-rearward direction further behind the upward protruding piece 7*c* in the forward portion 7*b* of the backrest supporting rod 7.

The armrest device 9 includes an armrest post 10 and an armrest 11 attached to an upper end of the armrest post 10.

The armrest post 10 includes a lower support rod 12 (support) forming a substantial L-shape in a front view by an inward portion 12*b* directed to slightly downward from an inner side of a lower end of the rising portion 12*a* continuously provided on the lower end of the rising portion 12*a* (support) directed to an up-down direction, and an upper support cylinder 14 mounted on the rising portion 12*a* in a height adjustable manner by using the height adjustment device 13, and the armrest 11 is attached to an upper end of the upper support cylinder 14.

The inward portion 12*b* in the lower support rod 12 has an elliptical cross-section that is elongated in the frontward-rearward direction, and the cross-sectional area thereof increases gradually inward (supporting base 6 side). An inner end surface of the inward portion 12*b* is formed with an inward protrusion 15 that forms an oval or elliptical shape that is elongated in the frontward-rearward direction as a lateral shape and forms a bifurcated shape having a longitudinal groove 15*a* at the center thereof as a planar shape.

A recessed portion 16 for allowing a head 20*a* of a bolt 20 to be described below to be easily inserted thereinto is formed from an outer end portion to the vicinity of an inner end in a lower surface of the inward portion 12*b* of the lower support rod 12.

Additionally, a bolt insertion hole 17 that opens at a central portion of the longitudinal groove 15*a* in the inward protrusion 15 is provided toward the left-right direction (extending direction of the inward portion 12*b*) within the inward portion 12*b*.

An attaching portion of the lower support rod 12 further behind the upward protruding piece 7*c* in the forward portion 7*b* of the backrest supporting rod 7 is provided with a recessed portion 18 into which the inward protrusion 15 fits, and an outer end surface of a protruding strip 18*a* that fits into the longitudinal groove 15*a* of the inward protrusion 15 and is directed to the up-down direction is provided with a female thread hole 19.

By fitting the inward protrusion 15 to the recessed portion 18 in this state, an inner end surface of the inward portion 12*b* of the lower support rod 12 abuts against an outside surface of the forward portion 7*b* of the backrest supporting rod 7. A shank 20*b* of the bolt 20 is inserted through the bolt insertion hole 17 such that the head 20*a* of the bolt 20 is located in the recessed portion 16, and a male thread portion 20*c* of the bolt 20 is screwed and fastened to the female thread hole 19 in the forward portion 7*b* of the backrest supporting rod 7. As a result, the lower support rod 12 is firmly anchored to the backrest supporting rod 7 without positional deviation in the frontward-rearward direction and in the left-right direction, and the rising portion 12*a* of the lower support rod 12 rises on a lateral side of the seat 4.

The appearance of the rising portion 12*a* of the lower support rod 12 forms an elliptical cross-section that is elongated in the frontward-rearward direction, and an upper end portion of the rising portion 12*a* forms a tubular shape by forming a recessed step portion 21 at the upper end portion of the rising portion 12*a*.

A recessed hole 21*b* that leads to the lower end portion of the rising portion 12*a* is provided at the center of a bottom surface 21*a* of the recessed step portion 21.

An upper front surface of the rising portion 12*a* of the lower support rod 12 is provided with a rectangular window hole 22 that communicates with the recessed step portion 21.

Additionally, both side portions in an upper portion of the rising portion 12*a* of the lower support rod 12 are provided with a pair of front and rear engaging holes 23 and 23.

An end cap 27, where a pair of hanging left and right side pieces 26 and 26 are provided on a lower surface of a blocking plate 25 having an insertion hole 24 directed to the up-down direction provided at the center thereof is mounted, at an upper end portion of the rising portion 12*a* of the lower support rod 12 so that the hanging side pieces 26 and 26 fit into the recessed step portion 21 and the lower surface of the blocking plate 25 abuts against an upper end surface of the rising portion 12*a*.

In a state where the end cap 27 is mounted on the upper end portion of the rising portion 12*a* of the lower support rod 12, pins 29 that are directed to the left-right direction are fitted into the engaging holes 23 and 23 penetrating in the left-right direction in the upper end portion of the rising portion 12*a* of the lower support rod 12, and engaging holes 28 and 28 provided in the left and right hanging side pieces 26 and 26 provided coaxially with the engaging holes 23 and 23, and the end cap 27 is prevented from coming off from the upper end portion of the rising portion 12*a* of the lower support rod 12.

A locking member 30 is fitted so as to be slidable in the frontward-rearward direction, in a space surrounded by the bottom surface 21*a* of the recessed step portion 21 in the upper end portion of the rising portion 12*a* of the lower support rod 12, the lower surface of the blocking plate 25 in the end cap 27, and both the left and right hanging side pieces 26 and 26.

As shown in FIGS. 2 to 4, and 6, an engaging protrusion 30*b* capable of being extended and retracted from a front surface of the rising portion 12*a* through the window hole 22 in the upper end portion of the rising portion 12*a* of the lower support rod 12 is provided at a front end of a substantially oval tubular trunk portion 30*a* directed to the up-down direction and is provided with an oval insertion hole 31 that is elongated in the frontward-rearward direction, at a central portion of the locking member 30. Any one of an inner surface of the insertion hole 31 is provided with a protrusion 30*c* that is directed inward, and a rear surface of the trunk portion 30*a* is provided with a spring receiving protrusion 30*d*. A lower surface of the engaging protrusion 30*b* forms an inclination surface that is directed forward and upward.

A compression coil spring 32 that is a biasing member directed to the frontward-rearward direction has a front end portion fitted to the spring receiving protrusion 30*d* in a compressed state, between the rear surface of the trunk portion 30*a* of the locking member 30 and a front surface of a rear wall portion within the recessed step portion 21 in the upper end portion of the rising portion 12*a* of the lower support rod 12.

The locking member 30 is biased forward by the compression coil spring 32 and is usually located at a locking position where the engaging protrusion 30*b* protrudes from the front surface of the rising portion 12*a* through the window hole 22. The locking member 30 is pushed rearward by a rotating rod 40 (actuating member) to be described below, and is thereby moved to an unlocking position where the engaging protrusion 30*b* is retracted into the window hole 22.

The upper support cylinder 14 forms an elliptical tubular shape that is elongated in the frontward-rearward direction, and includes an enlarged portion 14*a*, which has a cross-sectional area that increases upward and overhangs lengthwise particularly toward the front, at an upper end portion. A front portion of the enlarged portion 14*a* is provided with a window hole 33 through which portion of an operating lever 43 (operating member) to be described below is inserted. Additionally, a lower end portion of the upper support cylinder 14 is provided with an inward flange portion 14*b*. Moreover, an upper surface of the enlarged portion 14*a* is formed with a shallow recessed step portion 14*c*.

An inner cylinder 34 that is externally fitted to the rising portion 12*a* of the lower support rod 12 so as to be slidable in the up-down direction is internally fitted into the upper support cylinder 14.

An upper portion of the inner cylinder 34 is formed with an enlarged step portion 34*a* that is enlarged slightly more than portion therebelow, and the center of a bottom wall 35*a* of a recessed step portion 35 inside the enlarged step portion 34*a* is provided with an insertion hole 36 through which the rotating rod 40 to be described below is inserted.

A front surface of the enlarged step portion 34*a* is provided with a longitudinal groove 37 through which portion of the operating lever 43 is inserted in the frontward-rearward direction, and the inner side surfaces of ribs 35*b* and 35*b* that are provided on left and right inner side surfaces of the recessed step portion 35 behind the longitudinal groove 37 and are directed to the up-down direction are provided with U-shaped grooves 38 and 38 that receive and support a pivot 44 of the operating lever 43 and of which an upper end opens.

A plurality of rectangular engaging holes 39 are provided side by side in the up-down direction in a front surface in a portion below the enlarged step portion 34*a* in the inner cylinder 34. A lower edge of each engaging hole 39 forms an inclination surface that is directed rearward and downward.

Figure 5:
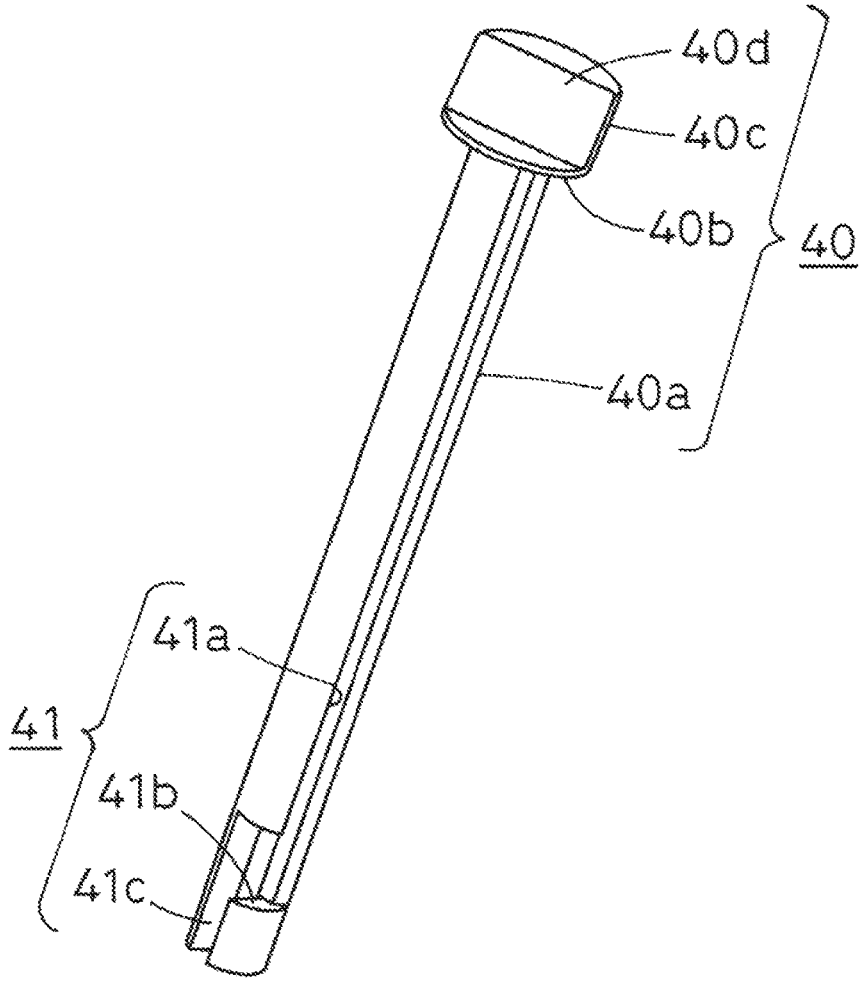
FIG. 5 is a perspective view when a rotating rod in the armrest device of FIG. 2 is viewed from a direction opposite to a direction in FIG. 2.

The rotating rod 40 is formed by providing a larger-diameter disc portion 40*b* continuously with an upper end of a columnar shank 40*a* that is concentric with the upper support cylinder 14 and the inner cylinder 34 and providing a semicircular-arc-shaped operated portion 40*c* continuously on the large-diameter disc portion 40*b*. As shown in FIG. 5, an outer peripheral surface of the shank 40*a* is provided with a crank-shaped recessed groove 41 including a longitudinal groove 41*a* that leads from portion directly below the disc portion 40*b* to the vicinity of a lower end portion of the shank 40*a* and extends in the up-down direction, a lateral groove 41*b* directed to a circumferential direction of the shank 40*a* from the lower end of the longitudinal groove 41*a*, and a longitudinal groove 41*c* that leads from an end portion opposite to a continuously connected end portion of the lateral groove 41*b* with the longitudinal groove 41*a* to the lower end of the shank 40*a* and extends in the up-down direction.

A planed surface used as the chord of the semicircle arc in the operated portion 40*c* forms an abutting surface 40*d* that is parallel to a central axis of the rotating rod 40, against which an actuating portion 43*b* of the operating lever 43 to be described below abuts.

In the rotating rod 40, the shank 40*a* is rotatably inserted into the recessed hole 21*b* of the rising portion 12*a* of the lower support rod 12 through the insertion hole 36 of the bottom wall 35*a* of the inner cylinder 34, the insertion hole 24 of the blocking plate 25 in the end cap 27, and the insertion hole 31 of the locking member 30 so that a lower surface of the disc portion 40*b* abuts against an upper surface of the bottom wall 35*a* of the inner cylinder 34 and the protrusion 30*c* of the locking member 30 fits into the longitudinal groove 41*a* in a relatively movable manner.

An interlocking mechanism 42 that interlocks the rotating rod 40 with the locking member 30 is formed by the longitudinal groove 41*a* in the rotating rod 40 and the protrusion 30*c* in the locking member 30 so that the locking member 30 is moved in a direction of the unlocking position by the rotation of the rotating rod 40 in one direction.

Figure 6:
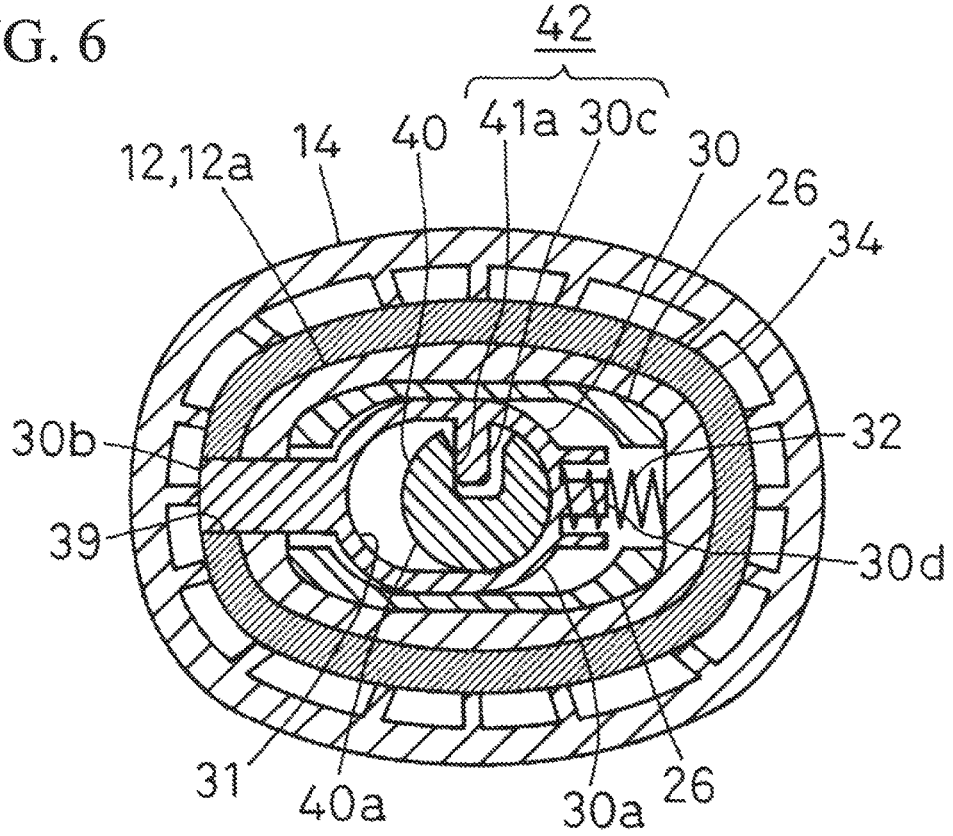
FIG. 6 is a cross-sectional view taken along line VI-VI of FIG. 3.

Namely, as shown in FIG. 6, if the rotating rod 40 is rotated clockwise in FIG. 6 from a state where the locking member 30 is located at the locking position, a side surface located ahead of the longitudinal groove 41*a* serves as an actuating portion to push back the protrusion 30*c*, and thereby, the locking member 30 moves rearward and is brought into the unlocking position against the biasing force of the compression coil spring 32.

As described above, the reason why the recessed groove 41 (action portion) is formed in the shape of a crank is because, when the upper support cylinder 14 is lifted to an upper limit together with the armrest 11, the protrusion 30*c* of the locking member 30 abuts against the lower end of the longitudinal groove 41*a* to prevent further lifting of the upper support cylinder 14, and because the rotating rod 40 is slightly rotated around the central axis in the middle of insertion so as to be allowed to enter into and leave from the rising portion 12*a* of the lower support rod 12.

The operating lever 43 is rotatably mounted into the recessed step portion 35 of the inner cylinder 34 by inserting both end portions of the pivot 44, which passes through an intermediate portion, in the frontward-rearward direction, of the operating lever 43 in the left-right direction, into the left and right U-shaped grooves 38 and 38 in the inner cylinder 34 from above, and the operating portion 43*a* of a front portion thereof protrudes downward from the window hole 33 through the longitudinal groove 37 of the inner cylinder 34 and the window hole 33 of the upper support cylinder 14.

Figure 7:
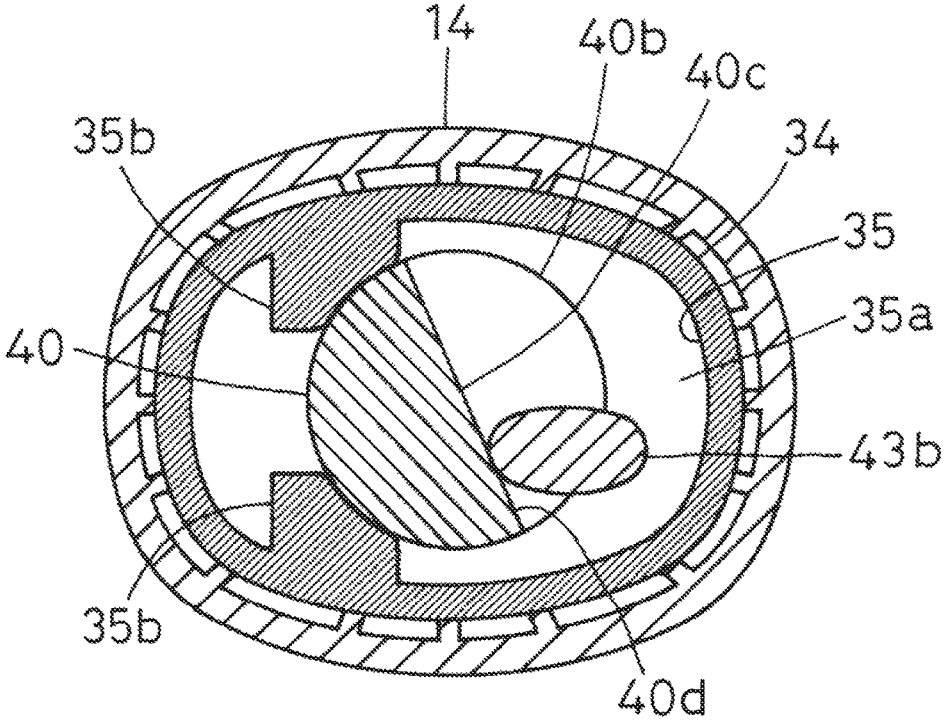
FIG. 7 is a cross-sectional view taken along line VII-VII of FIG. 3.

The actuating portion 43*b* behind the pivot 44 in the operating lever 43 is hook-shaped in a side view and protrudes rearward, and a tip portion of the actuating portion is laterally biased from the central axis of the rotating rod 40, and as shown in FIG. 7, abuts against an eccentric portion of the abutting surface 40*d* in the operated portion 40*c* of the rotating rod 40 from the rear.

A blocking member 45 is fitted into the recessed step portion 14*c* in the upper end of the upper support cylinder 14 and fixed with a set screw 46. An upward protrusion 47 is provided so as to protrude from a substantial central portion in an upper surface of the blocking member 45, and the armrest 11 is mounted on the blocking member 45 by using the upward protrusion 47.

The upper surface of the blocking member 45 and the upper end surface of the upper support cylinder 14 are a receiving and supporting surface that supports the armrest 11, and the upward protrusion 47 is an upper end portion of the armrest post 10 that protrudes upward from the receiving and supporting surface.

As the inner cylinder 34 is sandwiched between the blocking member 45 and the inward flange portion 14*b* of the upper support cylinder 14 from above and below, the inner cylinder 34 is prevented from separating from the upper support cylinder 14, and as the inner cylinder 34 is internally fitted tightly into the elliptical upper support cylinder 14, the inner cylinder 34 is prevented from rotating with respect to the upper support cylinder 14.

Additionally, the blocking member 45 also prevents the rotating rod 40 and the operating lever 43 from separating from the upper support cylinder 14 and the inner cylinder 34.

Usually, as the locking member 30 is biased forward by the biasing force of the compression coil spring 32 and is located at the locking position where the engaging protrusion 30*b* is engaged with any one of the engaging holes 39 of the inner cylinder 34, the inner cylinder 34, and the upper support cylinder 14 and the armrest 11 that are integrated with the inner cylinder 34 are held at an appropriate height.

When the height of the armrest 11 is changed from this state, the operating portion 43*a* of the operating lever 43 is pushed upward against the biasing force of the compression coil spring 32.

Then, the actuating portion 43*b* of the operating lever 43 rotates downward around the pivot 44, and the eccentric portion of the abutting surface 40*d* in the operated portion 40*c* of the rotating rod 40 is pushed forward by the tip of the actuating portion 43*b*. Therefore, the rotating rod 40 rotates clockwise in FIGS. 7 and 6, and the protrusion 30*c* of the locking member 30 is pushed rearward by the actuating portion 43*b* that is an inner side surface in front of the longitudinal groove 41*a*. Therefore, the locking member 30 moves rearward against the biasing force of the compression coil spring 32, and is brought into the unlocking position.

If the locking member 30 is retracted to the unlocking position, the engaging protrusion 30*b* of the locking member 30 is disengaged from the engaging hole 39 of the inner cylinder 34 that is fitted, and the armrest 11 and the upper support cylinder 14 are freely movable in the up-down direction with respect to the rising portion 12*a* of the lower support rod 12.

When a hand is left from the operating portion 43*a* of the operating lever 43 after the armrest 11 is moved to a desired height, the locking member 30 is pushed forward by the biasing force of the compression coil spring 32, and is stopped as the engaging protrusion 30*b* of the locking member 30 fits into any one of the engaging holes 39 of the inner cylinder 34 or the tip thereof abuts against the inner surface of the inner cylinder 34.

In the latter case, the engaging protrusion 30*b* is fitted into the nearest engaging hole 39 simply by slightly moving the armrest 11 either upward or downward after the above stop.

If the engaging protrusion 30*b* of the locking member 30 fits into any one of the engaging holes 39 of the inner cylinder 34 and the locking member 30 stops at the locking position, the inner cylinder 34, and the upper support cylinder 14 and the armrest 11 integral with the inner cylinder 34 are held at predetermined heights at that time.

Additionally, when someone wishes to pull the armrest 11 upward, it is only necessary to lift the armrest 11 upward. By means of the lifting of the inner cylinder 34 in this case, the inclination surface of the lower edge of the engaging hole 39 engaged with the engaging protrusion 30*b* of the locking member 30 pushes the inclination surface of the lower edge of the engaging protrusion 30*b* rearward and moves the locking member 30 to the unlocking position against the biasing force of the compression coil spring 32. If the engaging protrusion 30*b* is engaged with an engaging hole 39 in the following stage of the engaging hole 39 that has been engaged till then, the locking member 30 is moved again to the locking position by the biasing force of the compression coil spring 32, and then, the armrest 11 can be raised by every stage of the engaging holes 39 by repeating the same operation.

If the armrest 11 reaches an upper limit, the protrusion 30*c* of the locking member 30 abuts against the lower end of the longitudinal groove 41*a* in the recessed groove 41, and further lifting of the armrest 11 is prevented.

In the armrest device 9, the rotating rod 40 merely moves in the up-down direction with respect to the locking member 30 together with the armrest 11, and the relationship among the rotating rod 40, the locking member 30, and the interlocking mechanism 42 does not fluctuate at all. Hence, even if the armrest 11 is located at any height, locking and unlocking operations can always be lightly performed under the same conditions.

Moreover, since the relationship among the rotating rod 40, the locking member 30, and the interlocking mechanism 42 does not fluctuate, the possibility of erroneous operation or malfunction can be reduced.

Additionally, even if the movement stroke of the armrest 11 is made large, it is not necessary to make the length of the whole armrest 11 in the up-down direction large. Thus, miniaturization of the armrest device 9 and reduction of material costs can be achieved, and the degree of freedom of the attachment position of the armrest device 9 to the chair can be increased.

Among the above components, the lower support rod 12 serves as a support in a fixture, the upper support cylinder 14 serves as a movable member mounted on the support so as to be movable in the up-down direction, and the inner cylinder 34 serves as a guide member that is anchored to the upper support cylinder 14 as the movable member, is provided with the engaging portion including the plurality of engaging holes 39 arranged in the up-down direction, and is directed to the up-down direction. The height adjustment device 13 in the fixture is formed by these components, the locking member 30, the biasing member including the compression coil spring 32, the rotating rod 40, the interlocking mechanism 42, and the operating lever 43.

Next, the configuration of the armrest 11 in the armrest device 9 will be described in detail.

As shown in FIGS. 2 and 8 to 12, the armrest 11 includes an armrest supporting plate 50 that serves as a shielding member supported by the above-described blocking member 45, an armrest substrate 51 supported by the armrest supporting plate 50, holding member 71 that sandwiches the armrest supporting plate 50 and the armrest substrate 51 between the holding member 71 and the upper end surface of the armrest post 10 so as to be movable in a horizontal direction and immovable upward, and an elbow pad 52 mounted on the armrest substrate 51 so as to cover an upper surface of the holding member 71 and the armrest substrate 51 and made of an elastomer or the like. The above-described upward protrusion 47 that rises from the upper surface of the blocking member 45 as the receiving and supporting surface and forms the upper end portion of the armrest post 10 is formed from a pipe and is provided so as to protrude to the upper surface of the blocking member 45 by press-fitting a lower end portion of the upward protrusion 47 into a through-hole 53 drilled in the blocking member 45 or anchoring the lower end through welding or the like. A square nut 54 is anchored to an upper end of the upward protrusion 47 through welding or the like.

The armrest supporting plate 50 has a substantially oblong blocking plate 50*a* of which the frontward-rearward dimension is sufficiently greater than the length of the upper surface of the upper support cylinder 14 in the frontward-rearward direction, of which the left-right dimension is approximately equal to the width of the armrest substrate 51, and which is long in the frontward-rearward direction. A guide protrusion 55 for guiding the armrest substrate 51 in the frontward-rearward direction that is a second direction is provided on the upper surface of the central portion of the blocking plate 50*a* so as to protrude integrally and upward. The guide protrusion 55 forms a substantial square in a plan view of which the left-right width is approximately equal to the left-right dimension of the blocking member 45 and of which the up-down dimension is approximately equal to the thickness of the bottom surface plate 51*a* of the armrest substrate 51. Guide surfaces (sliding surfaces) 55*a* and 55*a* that are parallel to each other and are elongated in the frontward-rearward direction are provided on both side surfaces of the guide protrusion 55.

An elongated hole 56 directed to the left-right direction is formed at a central portion of the guide protrusion 55 so as to penetrate up and down, and a short edge piece 57 is provided at an opening edge of an upper surface of the elongated hole 56 so as to protrude upward.

By fitting the upward protrusion 47 of the blocking member 45 to the elongated hole 56 of the guide protrusion 55 in a relatively movable manner, the armrest supporting plate 50 is supported on the upper surface of the blocking member 45 of the upper end of the upper support cylinder 14 so as to be movable in the left-right direction and be horizontally rotatable around the upward protrusion 47. In addition, when the upward protrusion 47 has been fitted into the elongated hole 56 in a relatively movable manner, an upper end portion of the upward protrusion 47 including the square nut 54 protrudes slightly from an upper surface of the guide protrusion 55. Additionally, the length of the elongated hole 56 in the left-right direction is determined such that the elongated hole 56 does not protrude laterally from an upper end surface of the blocking member 45 even when the armrest supporting plate 50 has moved to a limit position where the upward protrusion 47 abuts against an end portion of the elongated hole 56.

An upward protruding piece 58 that couples a lower holding member 67 to be described below and is directed to the frontward-rearward direction is provided on an upper surface of a central portion of the armrest supporting plate 50 in the left-right direction in the front of the guide protrusion 55 so as to protrude upward. A rear end of the upward protruding piece 58 is coupled to a front surface of the guide protrusion 55. The up-down dimension of a front portion of the upward protruding piece 58 is made larger than that of a rear portion, and an upper half portion of the front portion of the upward protruding piece 58 is formed with a shaft-like widened portion 58*a* that has a larger diameter than the thickness of the upper half portion and has a female thread hole 59 in the up-down direction.

The armrest substrate 51 forms a substantially oblong shape of which the planar shape is elongated in the frontward-rearward direction, a protruding edge 60 is provided on an upper surface of a peripheral edge portion of a bottom surface plate 51*a* of the armrest substrate 51 so as to protrude obliquely outward and upward, and a rising piece 61 is provided so as to protrude upward longer than the protruding edge 60 along an inner side of the protruding edge 60. Left and right facing surfaces of a front portion and a rear portion in the rising piece 61 are coupled together by ribs 62 and 62 provided so as to protrude in the left-right direction from an upper surface of the bottom surface plate 51*a*.

A central portion of the bottom surface plate 51*a* in the armrest substrate 51, that is, the bottom surface plate 51*a* of the portion surrounded by the front and rear ribs 62 that face the rising piece 61 in the left-right direction is formed with a wide opening portion 63 extending in the frontward-rearward direction orthogonal to the elongated hole 56 provided in the guide protrusion 55. The opening portion 63 forms a substantial oblong shape in a plan view, and the left and right facing surfaces thereof are formed as a pair of guided surfaces 63*a* and 63*a* with which the left and right guide surfaces 55*a* of the above-described guide protrusion 55 come into sliding contact.

The opening portion 63 is always blocked by the armrest supporting plate 50. That is, the frontward-rearward dimension and left-right dimension of the armrest supporting plate 50, as will be described below, are made to be sizes such that the opening portion 63 is blocked by the armrest supporting plate 50 even when the armrest 11 has been moved to the maximum amount in the frontward-rearward direction and in the left-right direction, and neither a finger nor foreign matter enters the opening portion 63.

If the opening portion 63 of the armrest substrate 51 fits to the guide protrusion 55 of the armrest supporting plate 50, the left and right guide surfaces 55*a* of the guide protrusion 55 come into sliding contact with the left and right guided surfaces 63*a* of the opening portion 63. Accordingly, the armrest substrate 51 is supported on the upper surface of the armrest supporting plate 50 so as to be immovable and non-rotatable in the left-right direction, that is, movable only in the frontward-rearward direction. Accordingly, the armrest substrate 51 is movable in the left-right direction that is the first direction and rotates horizontally, together with the armrest supporting plate 50. In addition, when the opening portion 63 is made to fit to the guide protrusion 55, the upper surface of the guide protrusion 55 and the upper surface of the bottom surface plate 51*a* of the armrest substrate 51 are matched with each other in the same plane.

A slit 64 of which a rear end communicates with a front end of the opening portion 63, of which a front end leads to the vicinity of the rib 62 of a front portion, and which extends in the frontward-rearward direction is formed at the central portion of the bottom surface plate 51*a* of the armrest substrate 51 in the left-right direction in the front of the opening portion 63 so as to pass through the bottom surface plate 51*a*. As for the slit 64, when the armrest substrate 51 is placed on the armrest supporting plate 50, the widened portion 58*a* protrudes above the slit 64, and the upward protruding piece 58 is fitted to the armrest substrate 51 so as to be slidable in the frontward-rearward direction.

A pair of left and right guided surfaces 65 and 65 extending in the frontward-rearward direction are formed on upper surfaces of inward step portions that protrude inward from lower portions of left and right rising pieces 61 and 61 that face each other, between the front and rear ribs 62 and 62. Mutually facing inner side surfaces of rear half portions of the guided surfaces 65 and 65 are formed with a plurality of engaging grooves 66 that are recessed outward.

Holding member 71 including a lower holding member 67, an upper holding member 68, and a fixing member 69 and a bolt 70 that press these holding members down from above is mounted on an upper surface of the central portion of the bottom surface plate 51*a* of the armrest substrate 51.

The armrest supporting plate 50, and the lower holding member 67 that sandwiches the armrest substrate 51 so as to be movable in the frontward-rearward direction is accommodated in an inward recessed portion surrounded by the upper surface of the central portion of the bottom surface plate 51*a* of the armrest substrate 51, that is, the front and rear ribs 62 and the mutually facing left and right rising pieces 61 so as to be movable in the frontward-rearward direction. The lower holding member 67 is able to relatively move only in the frontward-rearward direction on the upper surface of the bottom surface plate 51*a* of the armrest substrate 51 by making the frontward-rearward dimension thereof smaller than the dimension between the front and rear ribs 62 and 62 and making the left-right dimension thereof approximately equal to the dimension between the mutually facing left and right rising pieces 61.

A central portion of a bottom surface plate 67*a* of the lower holding member 67 is formed with a fitting hole 72 that is elongated in left-right direction orthogonal to the opening portion 63 of the armrest substrate 51. The lower holding member 67 is placed on the upper surface of the bottom surface plate 51*a* of the armrest substrate 51 by fitting the fitting hole 72 to the edge piece 57 of the guide protrusion 55 in the armrest supporting plate 50. If the fitting hole 72 of the lower holding member 67 is made to fit into the edge piece 57 of the guide protrusion 55 in this way, the positioning between the armrest supporting plate 50 and the lower holding member 67 becomes easy, and the relative movement thereof is prevented.

Figure 2:
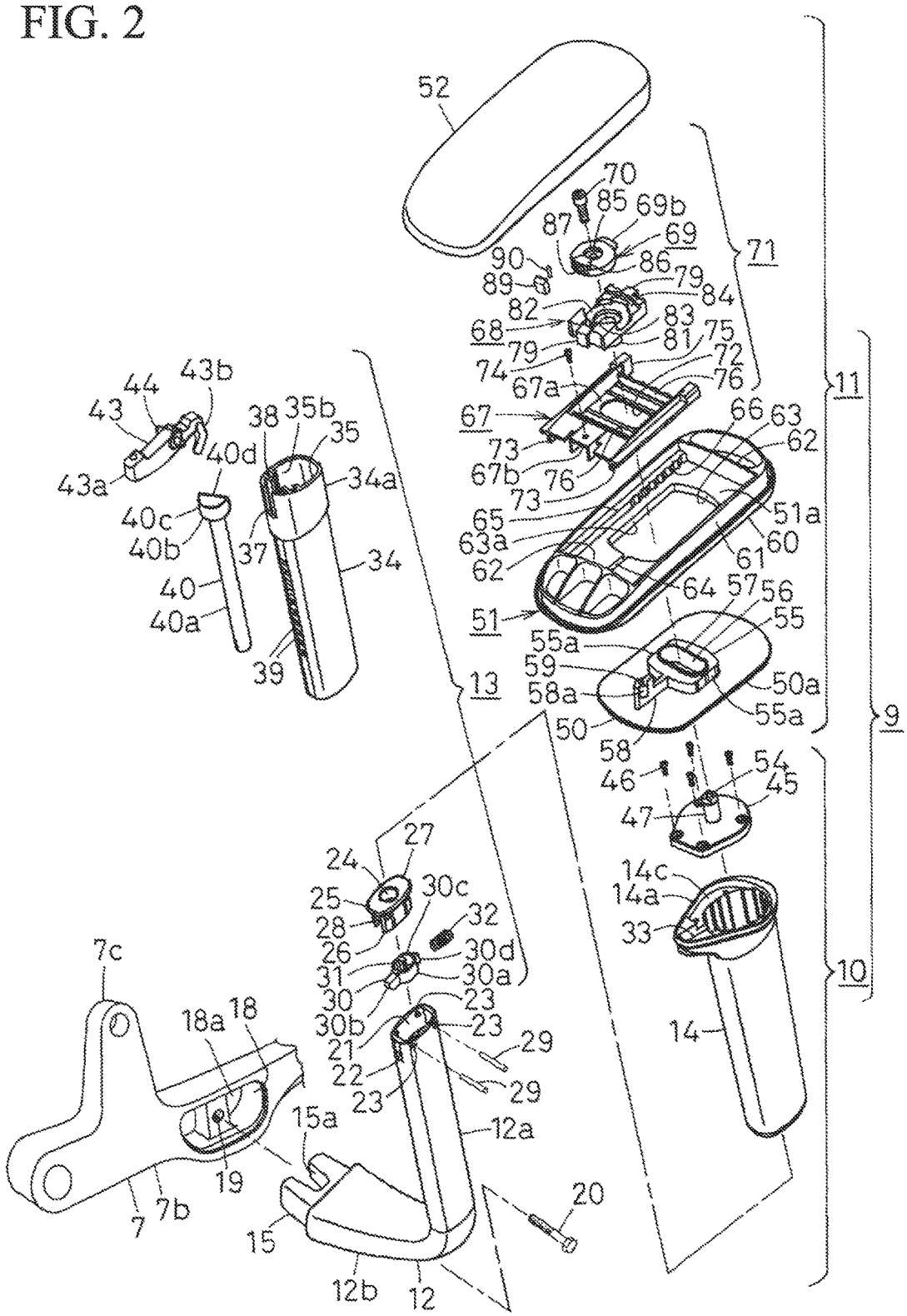
FIG. 2 is an exploded perspective view of portion of a backrest supporting rod and the armrest device in a first embodiment of the present invention.
Figure 3:
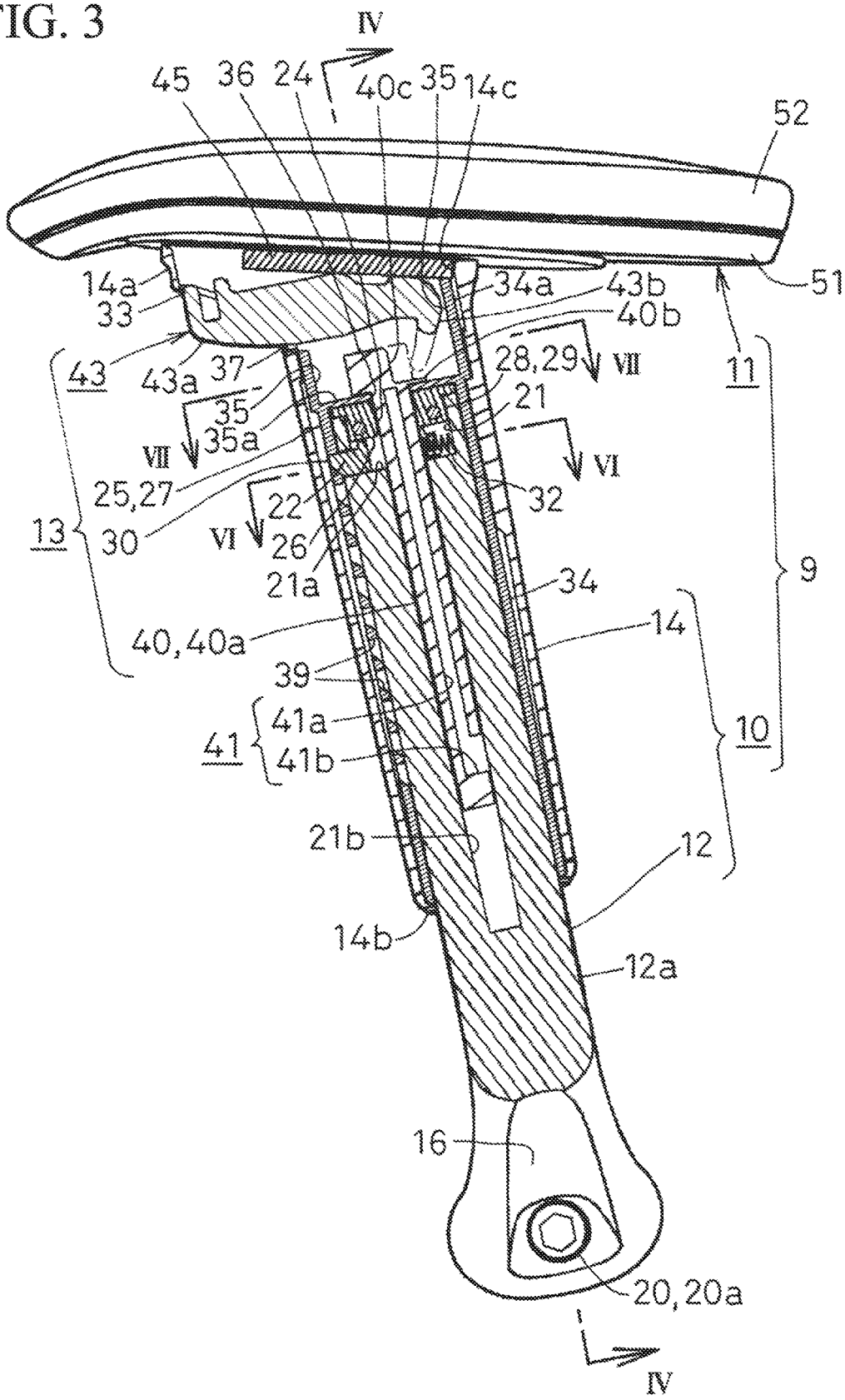
FIG. 3 is an enlarged vertical cross-sectional side view when an armrest post in the armrest device of FIG. 2 is cut by a vertical plane including its central axis.
Figure 4:
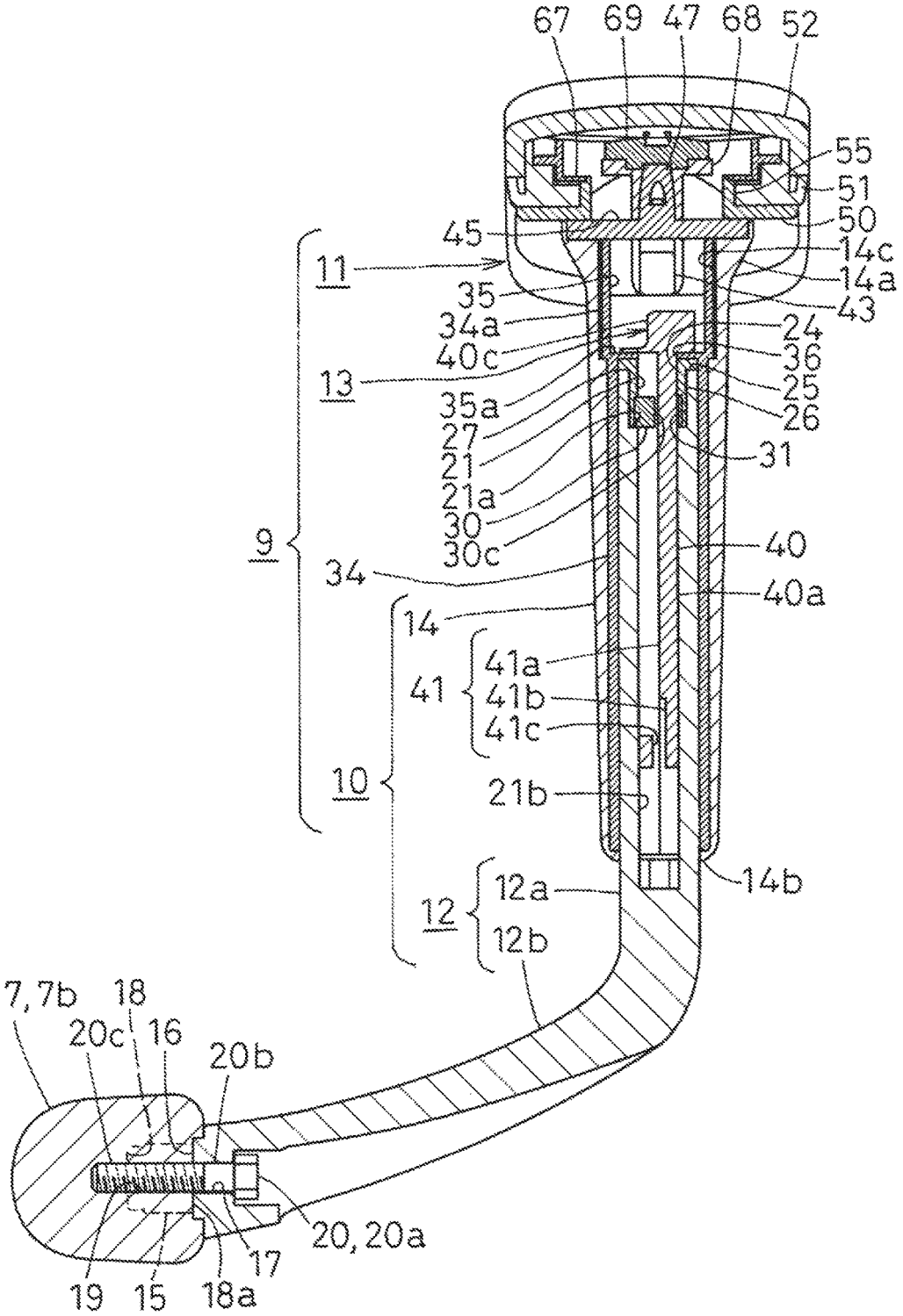
FIG. 4 is a cross-sectional view taken along line IV-IV of FIG. 3.
Figure 12:
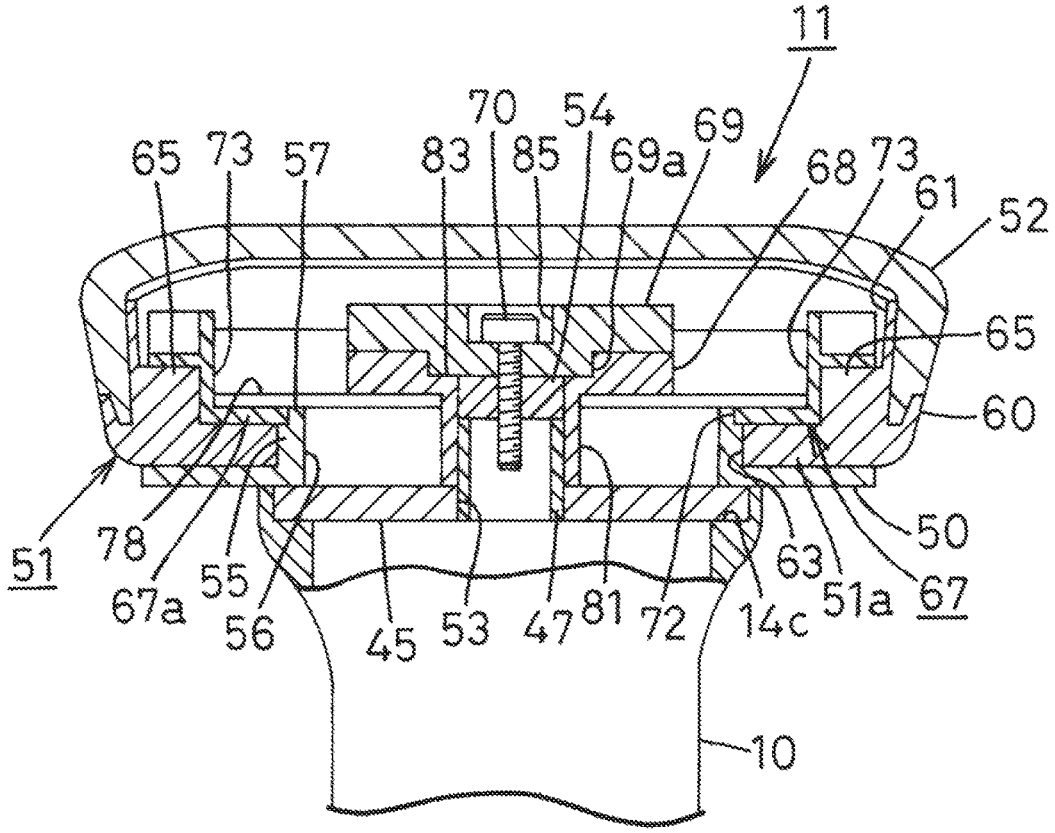
FIG. 12 is an enlarged vertical cross-sectional front view taken along line XII-XII of FIG. 10.

As shown in FIGS. 2 and 12, guide portions 73 and 73 having an L-shaped cross-section in a plan view are upwardly provided continuously with both left and right side edges of the bottom surface plate 67*a* of the lower holding member 67, and both the guide portions 73 come into sliding contact with the upper surface and inner side surfaces of the left and right guided surfaces 65 and 65 of the armrest substrate 51 so as to be movable in the frontward-rearward direction.

Figure 8:
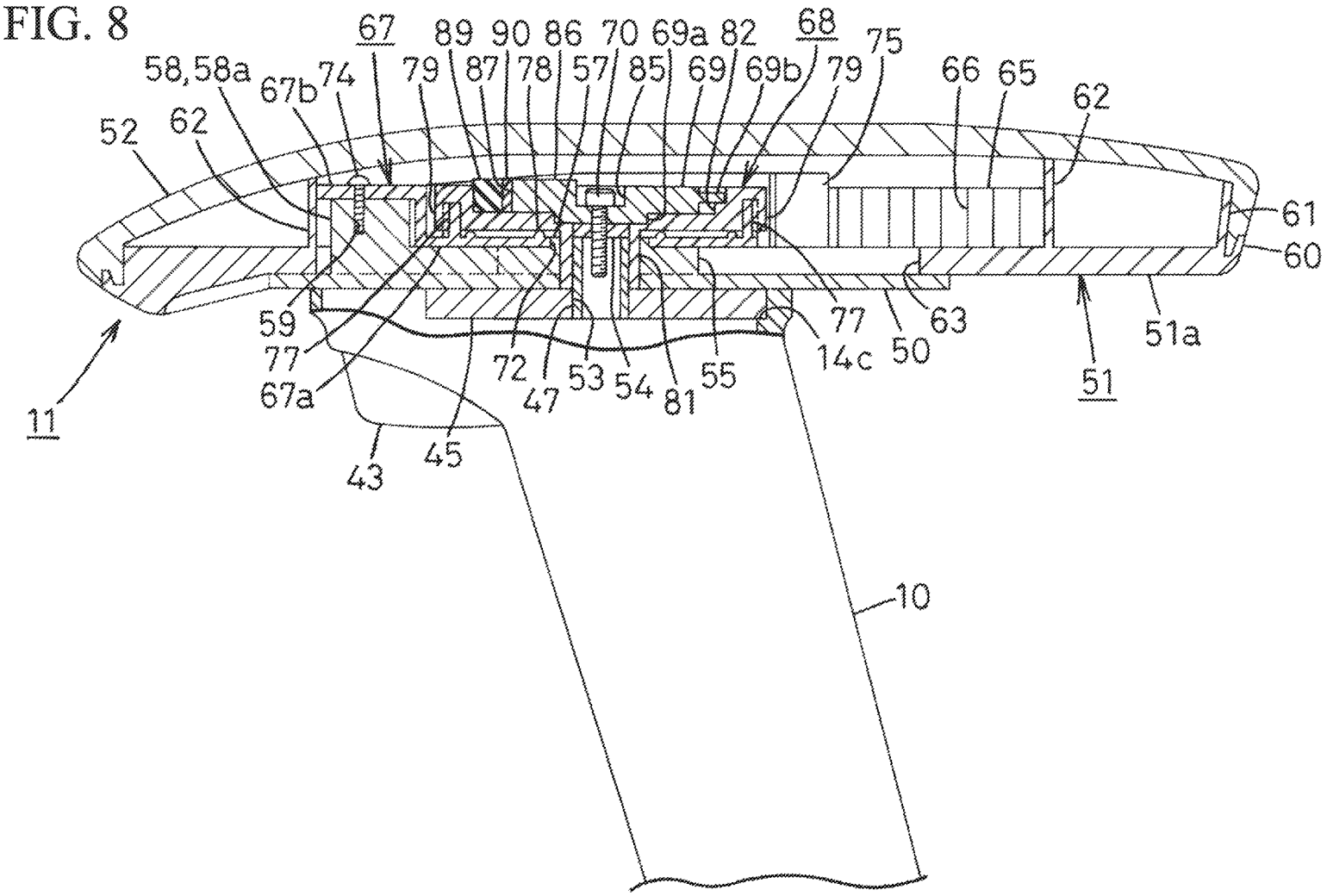
FIG. 8 is a central vertical cross-sectional side view of the armrest.

A forward piece 67*b* of which a lower end is connected to a front end of the bottom surface plate 67*a* and of which both left and right side ends are connected to the facing surfaces of front end upper portions of the left and right guide portions 73 is provided continuously with a front portion of the bottom surface plate 67*a*, and a central portion of the forward piece 67*b* in the left-right direction is coupled to an upper end of the widened portion 58*a* of the upward protruding piece 58 of the armrest supporting plate 50 with a screw 74 (refer to FIG. 8).

In addition, if the forward piece 67*b* is screwed to the upward protruding piece 58 of the armrest supporting plate 50, there is an advantage that the armrest supporting plate 50, the armrest substrate 51, and the lower holding member 67 are assembled in advance. However, as will be described below, since the lower holding member 67 is held by the upper holding member 68 and the fixing member 69, the upward protruding piece 58 and the forward piece 67*b* may be omitted.

Figure 11:
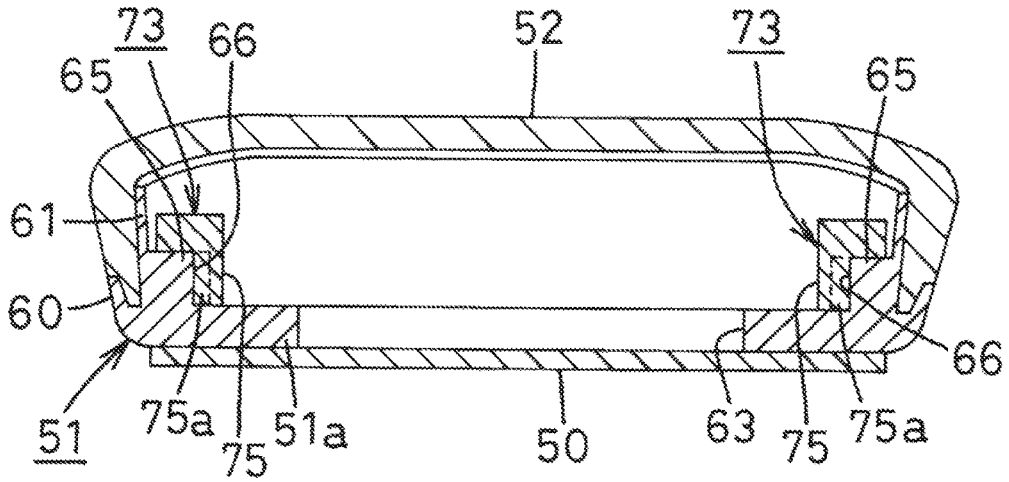
FIG. 11 is an enlarged vertical cross-sectional front view taken along line XI-XI of FIG. 10.

As shown in FIG. 11, downward elastic engaging pieces 75 are provided continuously with rear end portions of the left and right guide portions 73 so as to face the left and right guided surfaces 65, and engaging protrusions 75*a* that are selectively engaged with the engaging grooves 66 of the rear half portions of the guided pieces 65 are provided so as to protrude from outside surfaces of the both elastic engaging pieces 75.

Figure 9:
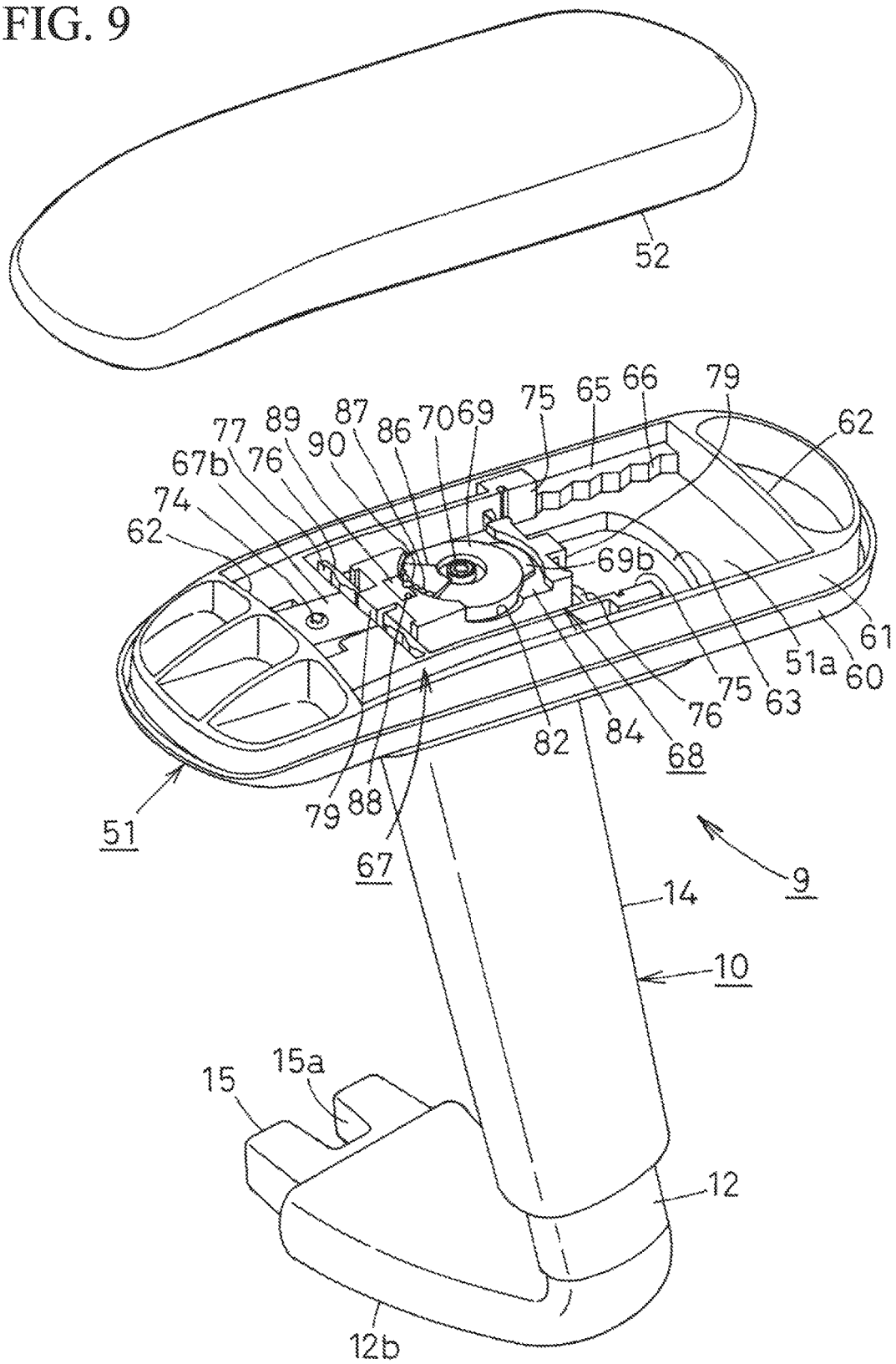
FIG. 9 is an assembling perspective view of the armrest device showing a state where an elbow pad is removed.
Figure 10:
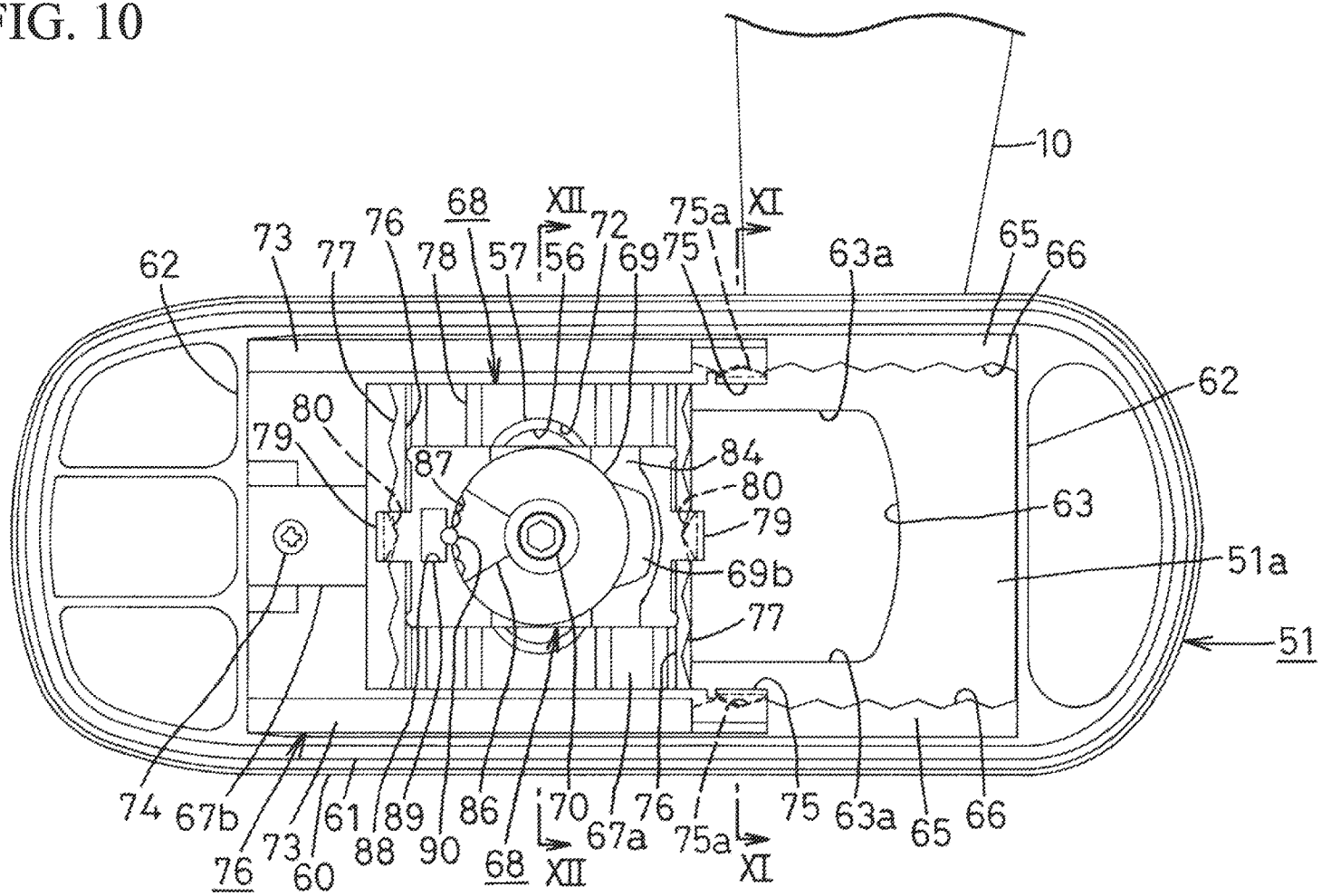
FIG. 10 is a plan view of the armrest in the state where the elbow pad is removed.

As shown in FIGS. 2, 9, and 10, a pair of front and rear guide pieces 76 and 76 extending in the left-right direction are erected from upper surfaces of a front portion and a rear end portion close to the forward piece 67*b* in the bottom surface plate 67*a* of the lower holding member 67 so as to face each other with the fitting hole 72 therebetween, and both side ends of the guide pieces 76 are connected to the facing surfaces of the left and right guide portions 73. A front surface of the front guide piece 76 is formed with a plurality of engaging grooves 77 that are recessed rearward, and a rear surface of the rear guide piece 76 is provided with a plurality of engaging grooves 77 that is recessed forward.

A plurality of (four in this example) parallel protruding strips 78 extending in the left-right direction are provided so as to protrude from an upper surface of the bottom surface plate 67*a* surrounded by the left and right guide portions 73 and the front and rear guide pieces 76 in the lower holding member 67.

The upper holding member 68 is accommodated within the inward recessed portion surrounded by the left and right guide portions 73 and the front and rear guide pieces 76 in the lower holding member 67 so as to be immovable in the frontward-rearward direction. The frontward-rearward dimension of the upper holding member 68 is a length such that the upper holding member 68 is slidable on the facing surface of the guide piece 76 of the lower holding member 67, and the left-right dimension thereof is smaller than the length between the facing surfaces of the guide portions 73 so as to be movable in the left-right direction between the pair of guide pieces 76. Accordingly, the upper holding member 68 is made movable in the left-right direction and non-rotatable with respect to the lower holding member 67. In addition, a lower surface of the upper holding member 68 is placed on the plurality of protruding strips 78 provided so as to protrude from the bottom surface plate 67*a* of the lower holding member 67, and the sliding friction resistance when the upper holding member 68 moves in the left-right direction with respect to the lower holding member 67 is made small by making the mutual contact area between the lower holding member 67 and the upper holding member 68 small.

As shown in FIGS. 9 to 11, hook-shaped elastic engaging pieces 79 and 79 engaged with the front and rear guide pieces 76 and 76 of the lower holding member 67 from above are provided at central portions in the left-right direction in front and rear edges of the upper holding member 68 so as to protrude outward. As the front and rear end surfaces of the upper holding member 68 and each elastic engaging piece 79 sandwiches each guide piece 76, the upper holding member 68 smoothly slides with respect to the lower holding member 67 in the left-right direction.

Each elastic engaging piece 79 is made to be elastically deformable outward, and the upper holding member 68 moves gradually and stably with respect to the lower holding member 67 with a feeling of moderation in the left-right direction by selectively and elastically engaging the engaging protrusion 80 (refer to FIG. 10) provided on the inner surface of the elastic engaging piece 79 with the plurality of engaging grooves 77 in the front and rear guide pieces 76 (refer to FIG. 9).

A tubular fitting protrusion 81 having an external diameter approximately equal to the frontward-rearward width of the elongated hole 56 of the armrest supporting plate 50 is provided on a lower surface of a central portion of the upper holding member 68 so as to protrude downward. By slidably fitting the fitting protrusion 81 to the elongated hole 56 and rotatably fitting the fitting protrusion 81 to the upward protrusion 47 of the blocking member 45, the upper holding member 68 is rotatably placed on the upper surface of the bottom surface plate 67*a* of the lower holding member 67 so as to be movable in the left-right direction with respect to the lower holding member 67 and rotatable with respect to the blocking member 45. In addition, the fitting protrusion 81 has a function as a spacer that uniformly maintains the up-down dimension between the blocking member 45 and the upper holding member 68. By making a lower end of the fitting protrusion 81 abut against the upper surface of the blocking member 45, a lower surface of the upper holding member 68 does not strongly abut against the upper surface of the bottom surface plate 67*a* of the lower holding member 67. In this way, if the lower end of the fitting protrusion 81 is made to abut against the upper surface of the blocking member 45 and the fitting protrusion 81 is fitted to the upward protrusion 47, the upward protrusion 47 is reinforced and the bending rigidity thereof increases. Thus, the armrest post 10 can support the armrest 11 more firmly.

The above-described circular fixing member 69 is rotatably accommodated in the recessed portion 82 that is formed at the upper surface of the central portion of the upper holding member 68 and is circular in a plan view. A circular protrusion 69*a* is provided on a lower surface of a central portion of the fixing member 69 so as to protrude downward. The circular protrusion 69*a* rotatably fits into an enlarged-diameter portion of a stepped fitting hole 83 formed in an upper surface of the recessed portion 82 (refer to FIG. 12).

A protruding piece 69*b* is provided at an upper portion of a rear surface of the fixing member 69 so as to protrude rearward. The protruding piece 69*b* slidably abuts against an upper surface of a step portion 84 formed in an upper surface of a rear portion of the upper holding member 68.

The fixing member 69 is screwed to the square nut 54 of the upward protrusion 47 of the blocking member 45 from above by inserting the bolt 70 into a stepped through-hole 85 of the up-down direction drilled at the center of the fixing member 69. In this way, the fixing member 69 is anchored to the upper end of the upward protrusion 47 within the recessed portion 82 of the upper holding member 68 such that the armrest supporting plate 50, the armrest substrate 51, the lower holding member 67, and the upper holding member 68 are pressed against the upper surface of the blocking member 45 sequentially from above. In this case, the fixing member 69 is fixed to the square nut 54 of the upward protrusion 47 so that a lower surface of the fixing member 69 does not strongly abut against an upper surface of the upper holding member 68 and the upper holding member 68 is rotatable with respect to the fixing member 69.

A plurality of engaging grooves 87 that are directed to the up-down direction are formed along a circumferential direction on a front surface of a fan-shaped thick wall portion 86 formed at a front portion of the fixing member 69. A front portion of the upper holding member 68 that faces the thick wall portion 86 is formed with an angular hole 88 of which an upper surface and a rear surface open and which is directed to the up-down direction, and an elastic body 89, such as rubber, is fitted into the angular hole 88 (refer to FIG. 9). A locking pin 90 directed to the up-down direction is sandwiched between a rear surface of a central portion of the elastic body 89 in the left-right direction and a surface that faces an engaging groove 87 so as to be biased rearward by the elastic body 89. As the locking pin 90 is selectively and elastically engaged with the plurality of engaging grooves 87, the whole armrest 11 including the upper holding member 68 can be rotated by a predetermined angle around the fixing member 69 with a feeling of moderation in a state where an appropriate resistance force is applied. In addition, the fixing member 69 having the above engaging grooves 87, the elastic body 89 inserted into the angular hole 88 of the upper holding member 68, and the locking pin 90 constitute resistance-force imparting member that imparts a resistance force to the horizontal rotation of the armrest 11.

In the armrest device 9 described above, the positioning of the armrest 11 in the frontward-rearward direction is performed as follows.

Figure 13:
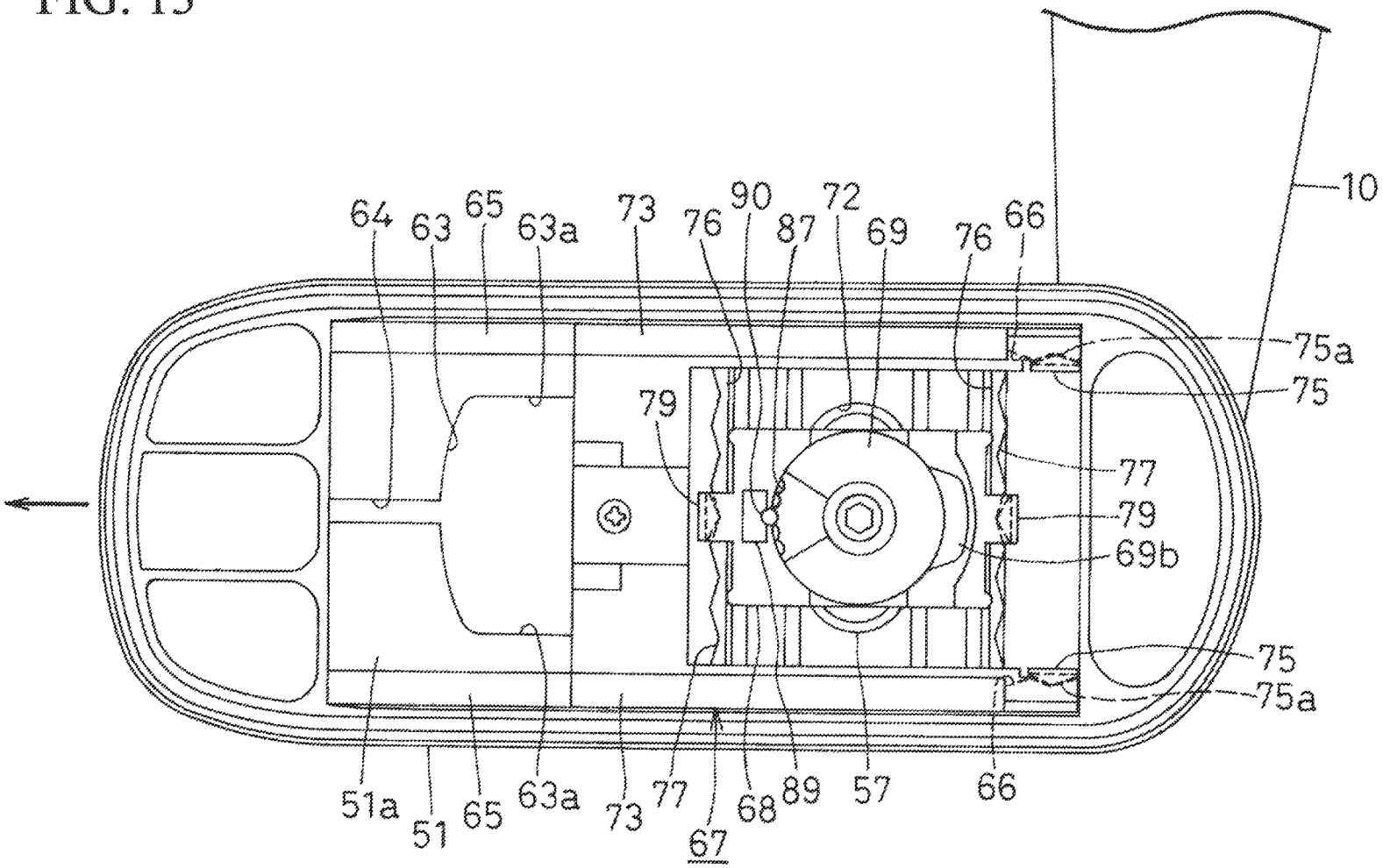
FIG. 13 is a plan view when the armrest is moved to the front.

FIG. 13 shows an example in which the elbow pad 52 located at a rear limit shown in FIG. 10 has been moved to a front limit (illustration of the elbow pad is omitted). In this case, if the elbow pad 52 is held with hands and pushed forward, only the armrest substrate 51 and the elbow pad 52 relatively move forward with respect to the armrest supporting plate 50 fitted to the upward protrusion 47 of the blocking member 45 so as to be immovable in the frontward-rearward direction, the lower holding member 67 coupled to the armrest supporting plate 50 on the upper surface of the armrest substrate 51 so as to be immovable in the frontward-rearward direction, the upper holding member 68 attached to the upper surface of the lower holding member 67 so as to be immovable in the frontward-rearward direction, and the fixing member 69 screwed to the upward protrusion 47 of the blocking member 45.

If the armrest substrate 51 moves forward, the pair of left and right elastic engaging pieces 75 and 75 of the rear end portion of the lower holding member 67 moves rearward along the guided pieces 65 while being engaged with and disengaged from the plurality of engaging grooves 66 provided at the rear portions of the pair of left and right guided surfaces 65 and 65 in the armrest substrate 51, whereby the armrest substrate 51 moves to a front limit position with a feeling of moderation.

In this case, since the frontward-rearward dimension and left-right dimension of the armrest supporting plate 50 are sizes such that the opening portion 63 of the armrest substrate 51 is always blocked, there is no possibility that a finger or foreign matter may enter the opening portion 63 even if the armrest substrate 51 is moved to front and rear limit positions.

In addition, since the front and rear positions of the armrest substrate 51 are gradually adjustable by the number of the engaging grooves 66, the front and rear positions can also be adjusted to arbitrary intermediate positions.

Figure 14:
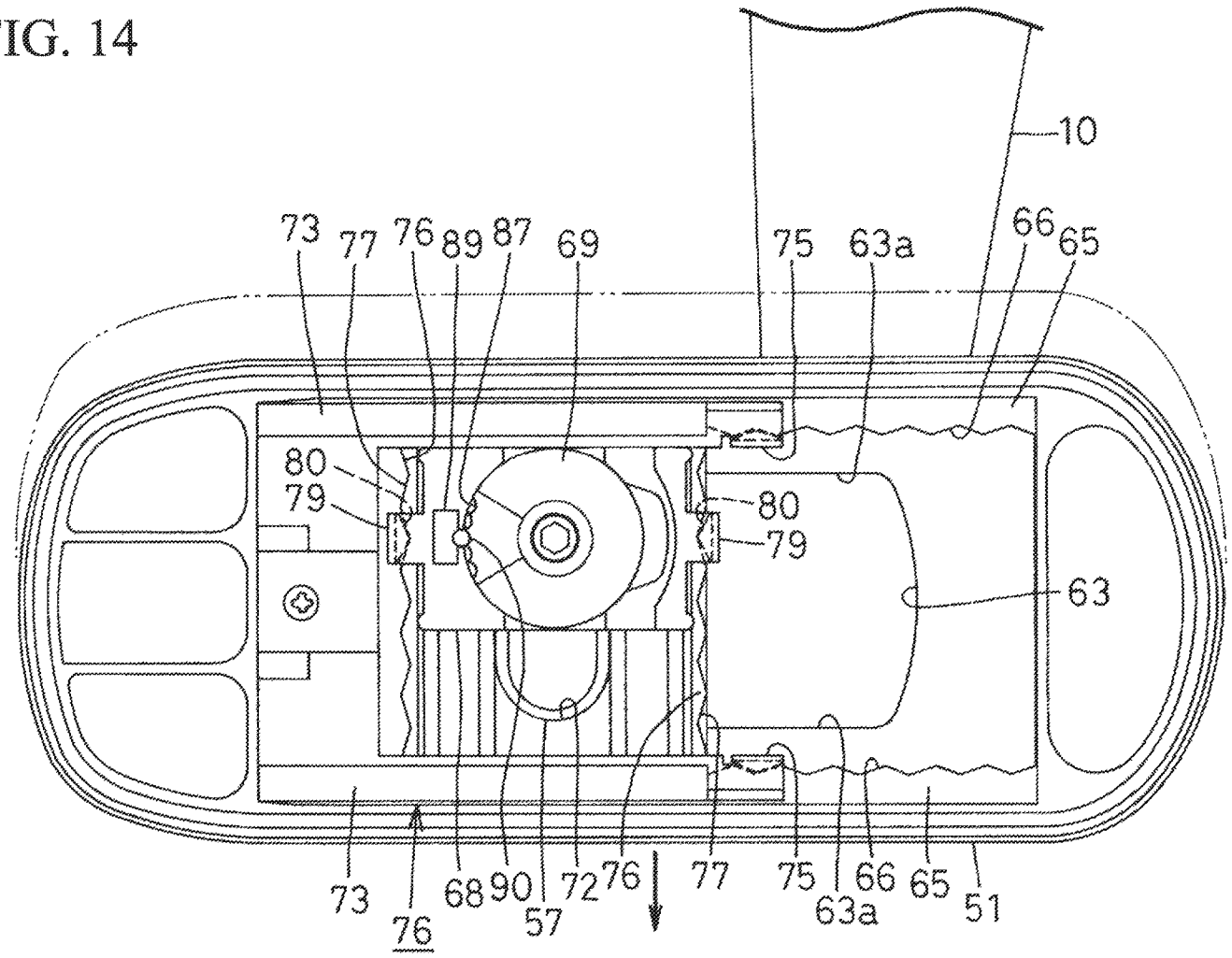
FIG. 14 is a plan view when the armrest is moved to an outer side.

FIG. 14 shows an example in which the elbow pad 52 is translated in the left-right direction, that is, outwardly and laterally and the position thereof in the left-right direction is adjusted. In this case, since the armrest supporting plate 50, the armrest substrate 51, and the lower holding member 67 move outwardly and laterally with respect to the upper holding member 68, the pair of front and rear elastic engaging pieces 79 of the upper holding member 68 are translated inwardly and laterally along the pair of front and rear guide pieces 76 of the lower holding members 67. Accordingly, as the engaging protrusions 80 of the front and rear elastic engaging pieces 79 are selectively engaged with the plurality of engaging grooves 77 provided in the front and rear guide pieces 76, the adjustment of the left and right positions of the elbow pad 52 can be gradually performed with a feeling of moderation.

In this case, since the opening portion 63 of the armrest substrate 51 is fitted to the guide protrusion 55 of the armrest supporting plate 50 so as to be relatively immovable in the left-right direction, the armrest supporting plate 50 moves in the left-right direction together with the armrest substrate 51. Accordingly, even if the elbow pad 52 is moved to the maximum amount in the left-right direction, the opening portion 63 of the armrest substrate 51 is not exposed to the outside, and there is no possibility that a finger or foreign matter may enter the opening portion 63.

Additionally, since the positional relationship in the left-right direction between the armrest supporting plate 50 and the armrest substrate 51 does not change, the elbow pad 52 can be stably supported by the armrest supporting plate 50, and the armrest supporting plate 50 and the armrest substrate 51 do not slide relative to each other in the left-right direction. Thus, any wear between mutual abutting surfaces can be prevented.

Figure 15:
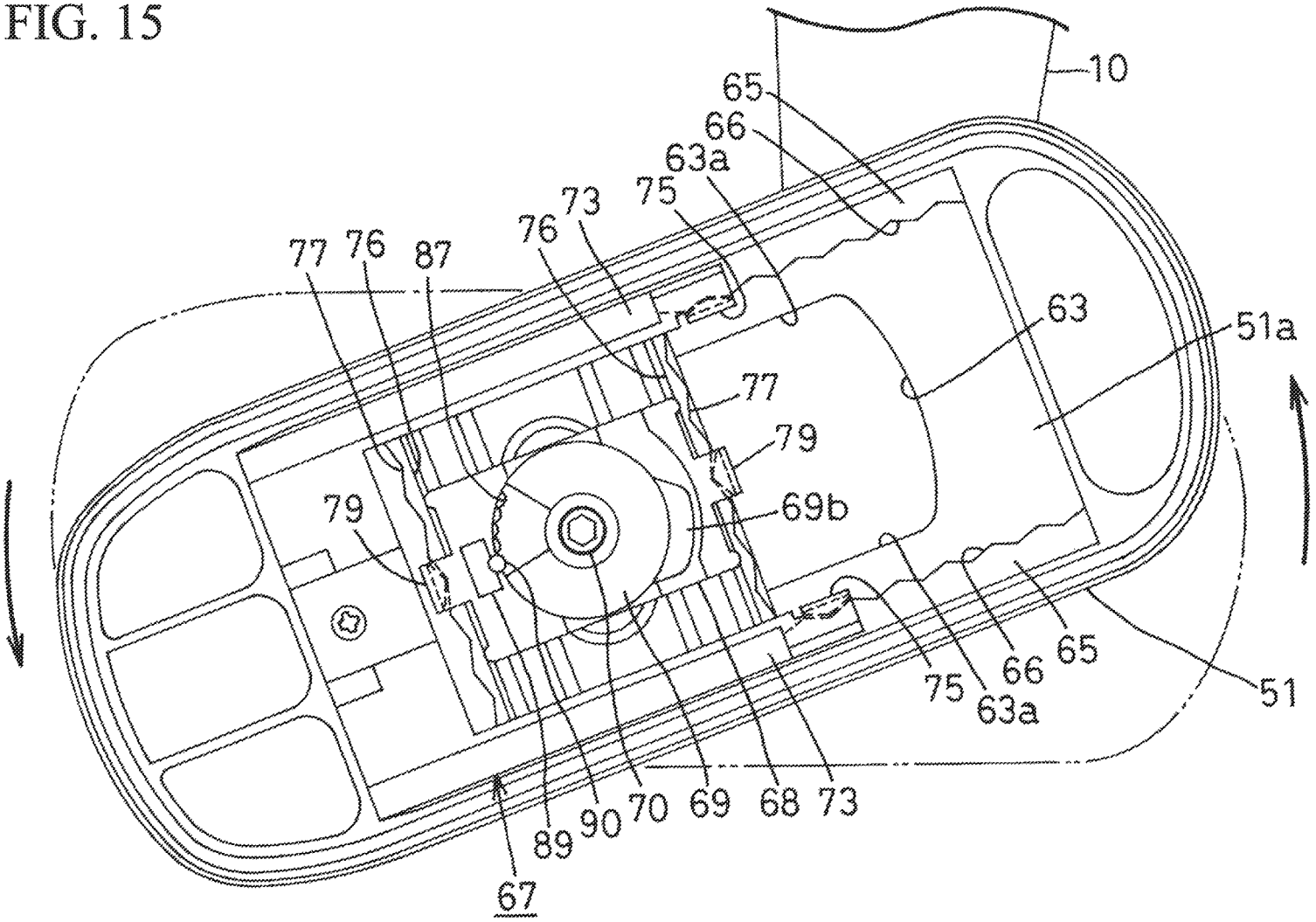
FIG. 15 is a plan view when the armrest is rotated counterclockwise.

FIG. 15 shows an example in which the elbow pad 52 rotates counterclockwise in a plan view with respect to the armrest post 10, and the orientation thereof in the left-right direction is adjusted. In this case, the armrest supporting plate 50, the armrest substrate 51, the lower holding member 67, and the upper holding member 68 rotate relative to the fixing member 69.

If the upper holding member 68 rotates relative to the fixing member 69, the engaging grooves 87, with which the locking pin 90 biased rearward by the elastic body 89 fitted into the angular hole 88 of the upper holding member 68 is elastically engaged, sequentially fluctuate one by one, and the orientation of the elbow pad 52 in the left-right direction is adjusted. This adjustment can be performed gradually by the number of the engaging grooves 87 with a feeling of moderation. In this case, since the guide protrusion 55 of the armrest supporting plate 50 is fitted into the opening portion 63 of the armrest substrate 51 so as to be relatively non-rotatable, the armrest supporting plate 50 rotates together with the armrest substrate 51. Accordingly, even if the orientation of the elbow pad 52 in the left-right direction is adjusted, the opening portion 63 is not exposed to the outside, and there is no possibility that a finger or foreign matter may enter the opening portion 63. Additionally, since the positional relationship in the left-right direction between the armrest supporting plate 50 and the armrest substrate 51 does not change, the elbow pad 52 can be stably supported, and any wear between mutual abutting surfaces can be prevented.

As described above, in the armrest device 9 of the above embodiment, the armrest supporting plate 50 that supports the armrest substrate 51 and has a large frontward-rearward dimension and left-right dimension is provided between the upper surface of the blocking member 45 fixed to the upper end portion of the upper support cylinder 14 that is the upper end of the armrest post 10, and the armrest substrate 51. Since the wide guide protrusion 55 provided so as to protrude from the upper surface of the armrest supporting plate 50 fits into the wide opening portion 63 that is provided at the armrest substrate 51 and is directed to the frontward-rearward direction so as to be relatively movable in the frontward-rearward direction, relatively immovable in the left-right direction, and relatively non-rotatable, the armrest substrate 51 can be supported with a large supporting area by the armrest supporting plate 50 even if the elbow pad 52 is moved in the left-right direction or rotated.

Accordingly, the elbow pad 52 can be stably supported by the armrest post 10 via the armrest supporting plate 50. Additionally, the elbow pad 52 can be stably moved in the frontward-rearward direction while the armrest substrate 51 is guided by the guide protrusion 55 fitted into the wide opening portion 63. Particularly, even if the elbow pad 52 is horizontally rotated, a lower surface of the armrest substrate 51 is widely supported. Thus, even if an elbow is put on the elbow pad 52 that has been horizontally rotated, a possibility that the elbow pad 52 may be shaken in the up-down direction or a bending load may be applied to the upward protrusion 47 becomes small.

Additionally, since the armrest substrate 51 is sandwiched from above and below by the armrest supporting plate 50 with a large frontward-rearward dimension and left-right dimension and the lower holding member 67 coupled to the armrest supporting plate 50, the elbow pad 52 can be prevented from being shaken in the up-down direction and can be stably moved in any direction. Moreover, the armrest supporting plate 50 moves in the left-right direction and rotates together with the armrest substrate 51, and widely supports the lower surface of the armrest substrate 51. Accordingly, even if an elbow is put on the elbow pad 52 in a state where the elbow pad 52 is moved in the frontward-rearward direction and in the left-right direction or rotated horizontally, a possibility that the elbow pad 52 may be shaken in the up-down direction or a bending load may be applied to the upward protrusion 47 becomes small.

Moreover, both left and right side portions within the recessed portion of the armrest substrate 51 are provided with a pair of guided surfaces 65 that face each other with the opening portion 63 therebetween, and the pair of guide portions 73 provided at both the left and right side portions of the lower holding member 67 are guided by the guided surfaces 65 so as to be in relatively movable in the frontward-rearward direction. Accordingly, since the elbow pad 52 is stably movable in the frontward-rearward direction and the contact area and sliding resistance between the armrest substrate 51 and the lower holding member 67 becomes small, the elbow pad 52 can be smoothly moved in the frontward-rearward direction. Additionally, since the pair of guided surfaces 65 are provided within the recessed portion of the armrest substrate 51, the height of the armrest substrate 51 does not become high.

The upward protrusion 47 is fitted into the elongated hole 56 of the guide protrusion 55, the up-down dimension of the guide protrusion 55 is approximately equal to the thickness of the bottom surface plate 51*a* of the armrest substrate 51, the lower holding member 67 is accommodated in the recessed portion of the upper surface of the armrest substrate 51, the upper holding member 68 is accommodated in the recessed portion of the upper surface of the lower holding member 67, and the fixing member 69 is accommodated in the recessed portion 82 of the upper surface of the upper holding member 68. Accordingly, the members that constitute the holding member 71 can be easily mounted within the recessed portion of the upper surface of the armrest substrate 51 simply by being overlapped sequentially from a lower member. Moreover, even if the holding member 71 is constituted of a plurality of upper and lower members, the overall height of the holding means 71 can be suppressed to be low, and the up-down dimension of the armrest substrate 51 and the whole armrest 11 can also be made small. As a result, the material costs for molding the armrest substrate 51, the elbow pad 52, or the like is cut down, and the appearance of the armrest device 9 becomes excellent.

Additionally, since the fixing member 69 is accommodated in the recessed portion 82 of the upper surface of the upper holding member 68, and the resistance-force imparting means of the armrest 11 including the engaging grooves 87, the elastic body 89, and the locking pin 90 is provided between the facing surfaces between the outer peripheral surface of the fixing member 69 and the upper holding member 68, the height of the resistance-force imparting means can also be suppressed to be low.

The upward protrusion 47 of the armrest post 10 is indirectly fitted into the opening portion 63 of the armrest substrate 51 and the fitting hole 72 of the lower holding member 67 via the guide protrusion 55 provided so as to protrude from the armrest supporting plate 50. Accordingly, the load when the elbow pad 52 is moved in the frontward-rearward direction and in the left-right direction with respect to the armrest post 10 or is rotated is not directly applied to a sliding portion between the upward protrusion 47, the opening portion 63, and the fitting hole 72, the wear of contact surfaces between the upward protrusion 47, the opening portion 63, and the fitting hole 72 is suppressed, and the elbow pad 52 can be smoothly moved for a long period of time.

Additionally, when the armrest 11 is moved in the left-right direction, the armrest substrate 51 and the armrest supporting plate 50 move integrally. Accordingly, by making the width of the armrest supporting plate 50 in the left-right direction be a dimension equal to or greater than the width of the opening portion 63 of the armrest substrate 51 in the left-right direction and equal to or smaller than the left-right width of the armrest substrate 51, the armrest supporting plate 50 does not stick out outwardly and laterally on the left and right of the armrest 11 and the appearance thereof can be kept excellent, even if the armrest 11 is at any position in the left-right direction.

In addition, in the above embodiment, the first direction and the second direction are made to be the left-right direction and the frontward-rearward direction that are orthogonal to each other within the horizontal plane. However, the first direction and the second direction are not limited to the two orthogonal directions, and can be arbitrary directions as long as these directions are two directions that intersect to each other.

Figure 16:
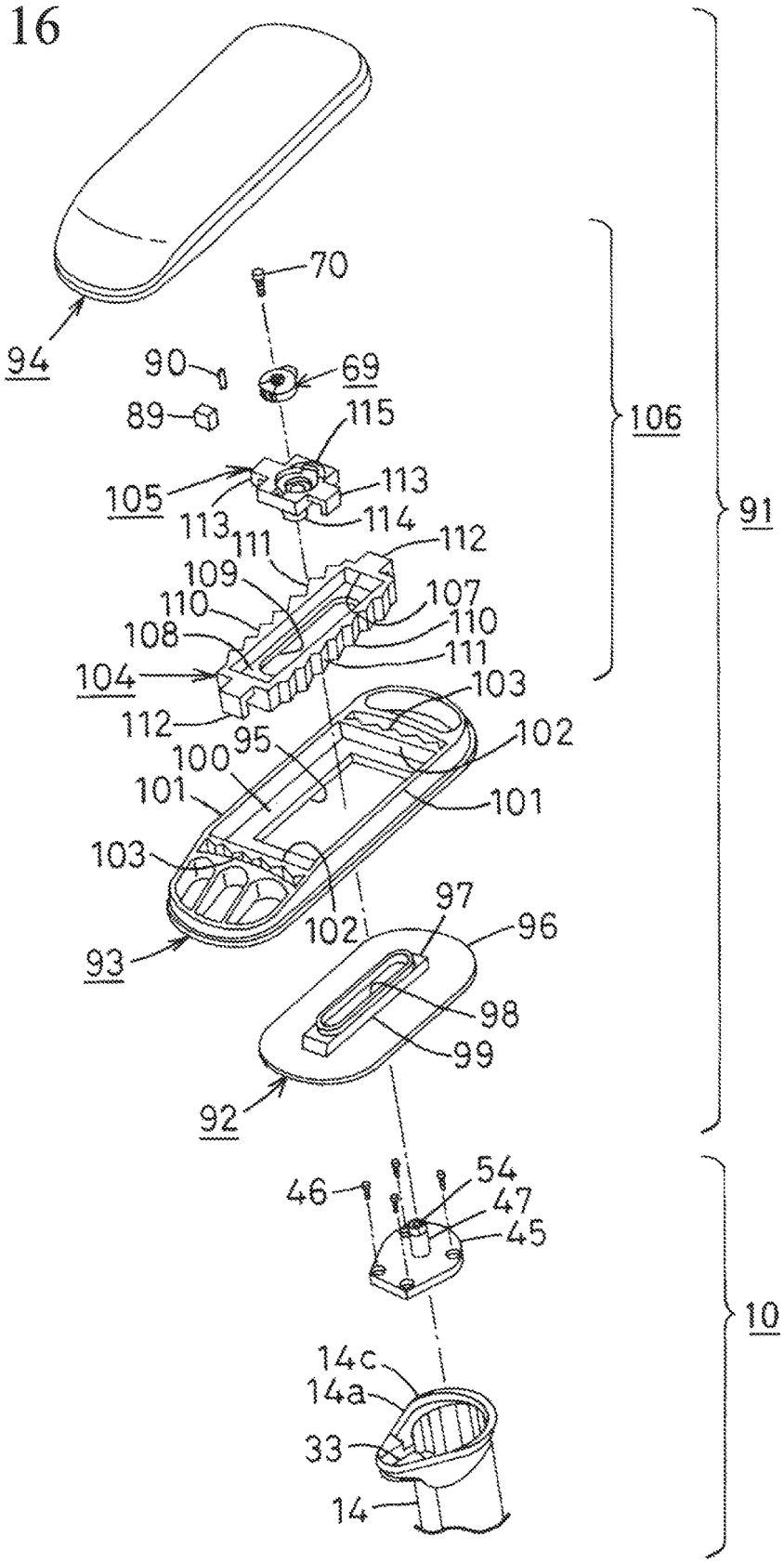
FIG. 16 is an exploded perspective view of a modification example of the armrest.

FIG. 16 shows a modification example of the armrest. In addition, the same portions as those of the above first embodiment will be designated by the same reference numerals, and a detailed description thereof will be omitted here.

In this armrest 91, a movement guiding mechanism in the left-right direction set to the first direction in the armrest 11 of the first embodiment shown in FIGS. 1 to 15 (particularly refer to FIG. 2) is adopted as a movement guiding mechanism in the frontward-rearward direction, and similarly, a movement guiding mechanism in the frontward-rearward direction set to the second direction is adopted as a movement guiding mechanism in the left-right direction. Therefore, even in this modification example, the first direction is the left-right direction, and the second direction is the frontward-rearward direction.

The armrest 91 includes an armrest supporting plate 92 equivalent to the armrest supporting plate 50, an armrest substrate 93 equivalent to the armrest substrate 51, holding member 106 equivalent to the holding member 71, and an elbow pad 94 equivalent to the elbow pad 52.

The armrest supporting plate 92 has a blocking plate 96 formed such that the frontward-rearward dimension thereof is a dimension between the frontward-rearward dimension of an opening portion 95, which is provided in the armrest substrate 93 and is elongated in the frontward-rearward direction, and the frontward-rearward dimension of the armrest substrate 93, and a guide protrusion 97 that is provided on an upper surface of the blocking plate 96.

An elongated hole 98 directed to the frontward-rearward direction is formed in the guide protrusion 97 so as to penetrate in the up-down direction, and a short edge piece 99 is provided at an opening edge of an upper surface of the elongated hole 98 so as to protrude upward.

By fitting the upward protrusion 47 of the blocking member 45 to the elongated hole 98 of the guide protrusion 97 in a relatively movable manner, the armrest supporting plate 92 is supported on the upper surface of the blocking member 45 so as to be relatively movable in the frontward-rearward direction, be relatively immovable in the left-right direction, and be horizontally rotatable around the upward protrusion 47.

A central portion of a bottom surface plate 100 in the armrest substrate 93 is formed with an opening portion 95 directed to the frontward-rearward direction. The opening portion 95 is always blocked by a blocking plate 96 of the armrest supporting plate 92. That is, the frontward-rearward dimension and left-right dimension of the blocking plate 96, as will be described below, are made to be sizes such that the whole opening portion 95 is blocked by the blocking plate 96 even when the armrest substrate 93 has been moved to the maximum amount in the frontward-rearward direction and in the left-right direction, and no foreign matter enters the opening portion 95.

By fitting the opening portion 95 of the armrest substrate 93 to the guide protrusion 97 of the armrest supporting plate 92 so as to be relatively immovable in the frontward-rearward direction, relatively movable in the left-right direction, and relatively non-rotatable the armrest substrate 93 is supported on the upper surface of the armrest supporting plate 92 so as to be relatively movable only in the left-right direction. Accordingly, the armrest substrate 93 is movable in the frontward-rearward direction that is the second direction and is horizontally rotatable, together with the armrest supporting plate 92.

Guide pieces 102 and 102 extending in the left-right direction are provided outside from front and rear end edges of the opening portion 95 in the armrest substrate 93 between left and right rising pieces 101 and 101, and outer surfaces of the guide pieces 102 and 102 are respectively formed with a plurality of engaging grooves 103 that are recessed inward.

Holding member 106 including a lower holding member 104, an upper holding member 105, the fixing member 69, and the bolt 70 is mounted on an upper surface of a central portion of the bottom surface plate 100 of the armrest substrate 93.

The lower holding member 104 that sandwiches the armrest substrate 93 between the lower holding member 104 and the armrest supporting plate 92 so that the armrest substrate 93 is relatively movable in the frontward-rearward direction and in the left-right direction is accommodated on an upper surface of the bottom surface plate 100, within an inward recessed portion surrounded by the upper surface of the central portion of the bottom surface plate 100 of the armrest plate 93, that is, the front and rear guide pieces 102 and the left and right rising pieces 101 so as to be movable in the left-right direction. The lower holding member 104 is able to relatively move only in the left-right direction with respect to the armrest substrate 93 by making the left-right dimension thereof smaller than the dimension between the left and right rising pieces 101 and 101 and making the frontward-rearward dimension thereof approximately equal to the dimension between the mutually facing front and rear guide pieces 102 and 102.

A central portion of the lower holding member 104 is provided with an oblong recessed portion 107 directed to the frontward-rearward direction, and a bottom surface plate 108 of the recessed portion 107 is formed with a fitting hole 109 extending in the frontward-rearward direction. The lower holding member 104 is placed on the upper surface of the bottom surface plate 100 of the armrest substrate 93 by fitting the fitting hole 109 to the edge piece 99 of the guide protrusion 97 in the armrest supporting plate 92.

Outside surfaces of left and right rising portions 110 of the lower holding member 104 are formed with a plurality of engaging grooves 111 that are recessed inward.

Additionally, front and rear end portions of the lower holding member 104 are provided with hook-shaped elastic engaging pieces 112 and 112 engaged with the front and rear guides 102 from above, and an inner surface of a lower end portion of each elastic engaging piece 112 is elastically engageable with the plurality of engaging grooves 103 provided in each guide piece 102.

The upper holding member 105 is accommodated in an upper surface of the bottom surface plate 108 of the recessed portion 107 in the lower holding member 104. The left-right dimension of the upper holding member 105 is a dimension such that the upper holding member 105 comes into sliding contact with left and right inner side surfaces of the recessed portion 107 in the lower holding member 104, and the frontward-rearward dimension thereof is made considerably smaller than the dimension between front and rear inner side surfaces of the recessed portion 107. Accordingly, the upper holding member 105 is made relatively movable in the frontward-rearward direction, relatively immovable in the left-right direction, and relatively non-rotatable with respect to the lower holding member 104.

Central portions in the frontward-rearward direction in left and right edges of the upper holding member 105 are provided with hook-shaped elastic engaging pieces 113 and 113, and the same engaging protrusions (not shown) as the engaging protrusions 80 of FIG. 10 are respectively provided on inner surfaces of lower end portions of the elastic engaging pieces 113 and 113. The elastic engaging pieces 113 are fitted to the left and right rising portions 110 of the lower holding member 104 from above.

A tubular fitting protrusion 114 having an external diameter approximately equal to the left-right width of the elongated hole 98 of the armrest supporting plate 92 is provided on a lower surface of a central portion of the upper holding member 105 so as to protrude downward. The fitting protrusion 114 slidably fits into the fitting hole 109 of the lower holding member 104 and the elongated hole 98 of the armrest supporting plate 92, and rotatably fits to the upward protrusion 47 of the blocking member 45. Accordingly, the upper holding member 105 is placed on the upper surface of the bottom surface plate 108 of the lower holding member 104 so as to be relatively movable in the frontward-rearward direction with respect to the lower holding member 104 and relatively rotatable with respect to the armrest supporting plate 92. In addition, as the fitting protrusion 114 has the function as a spacer that keeps the up-down dimension between the blocking member 45 and the upper holding member 105 constant and makes the lower end of the fitting protrusion 114 abut against the upper surface of the blocking member 45, a lower surface of the upper holding member 105 does not strongly abut against the upper surface of the bottom surface plate 108 of the lower holding member 104.

The circular fixing member 69 (refer to FIG. 16) is accommodated in a relatively rotatable manner in the recessed portion 115 that is formed at the upper surface of the central portion of the upper holding member 105 and is circular in a plan view.

In the armrest device 9, when the elbow pad 94 is moved in the frontward-rearward direction, the armrest supporting plate 92 and the lower holding member 104 move integrally with the armrest substrate 93. Therefore, by making the frontward-rearward dimension of the blocking plate 96 of the armrest supporting plate 92 equal to or greater than the frontward-rearward dimension of the opening portion 95 of the armrest substrate 93 and equal to or smaller than the frontward-rearward dimension of the armrest substrate 93, the whole opening portion 95 can always be blocked by the blocking plate 96, and foreign matter can be prevented from entering the opening portion 95. Additionally, since the blocking plate 96 does not stick out in the frontward-rearward direction from front and rear end edges of the armrest substrate 93, an excellent appearance can be maintained.

Additionally, when the armrest 91 is moved in the left-right direction, the armrest substrate 93 relatively moves in the left-right direction with respect to the armrest supporting plate 92 and the lower holding member 104. In this case, since the whole opening portion 95 of the armrest substrate 93 is always blocked by the blocking plate 96 of the armrest supporting plate 92, foreign matter can be prevented from entering the opening portion 95.

In the above embodiment and modification example, a frontward-rearward direction may be the first direction, and the left-right direction may be the second direction.

<Second Embodiment>

Next, a second embodiment of the height adjustment device will be described with reference to FIGS. 17 to 23. A height adjustment device 120 of the second embodiment is different from the height adjustment device 13 of the first embodiment particularly in that the height adjustment device 13 of the first embodiment has the rising portion 12*a*, the upper support cylinder 14, and the inner cylinder 34 that extend linearly up and down, whereas the height adjustment device 120 of the second embodiment has a rising portion 121 (support), an upper support cylinder 122, and an inner cylinder 123 that form a curved shape that is convex outward to the left and right in a cross-sectional view in the frontward-rearward direction and extend up and down (refer to FIG. 19). In addition, although there are portions having different shapes or the like, the same components as those of the first embodiment will be designated by the same reference numerals, and a detailed description thereof will be omitted here.

Figure 17:
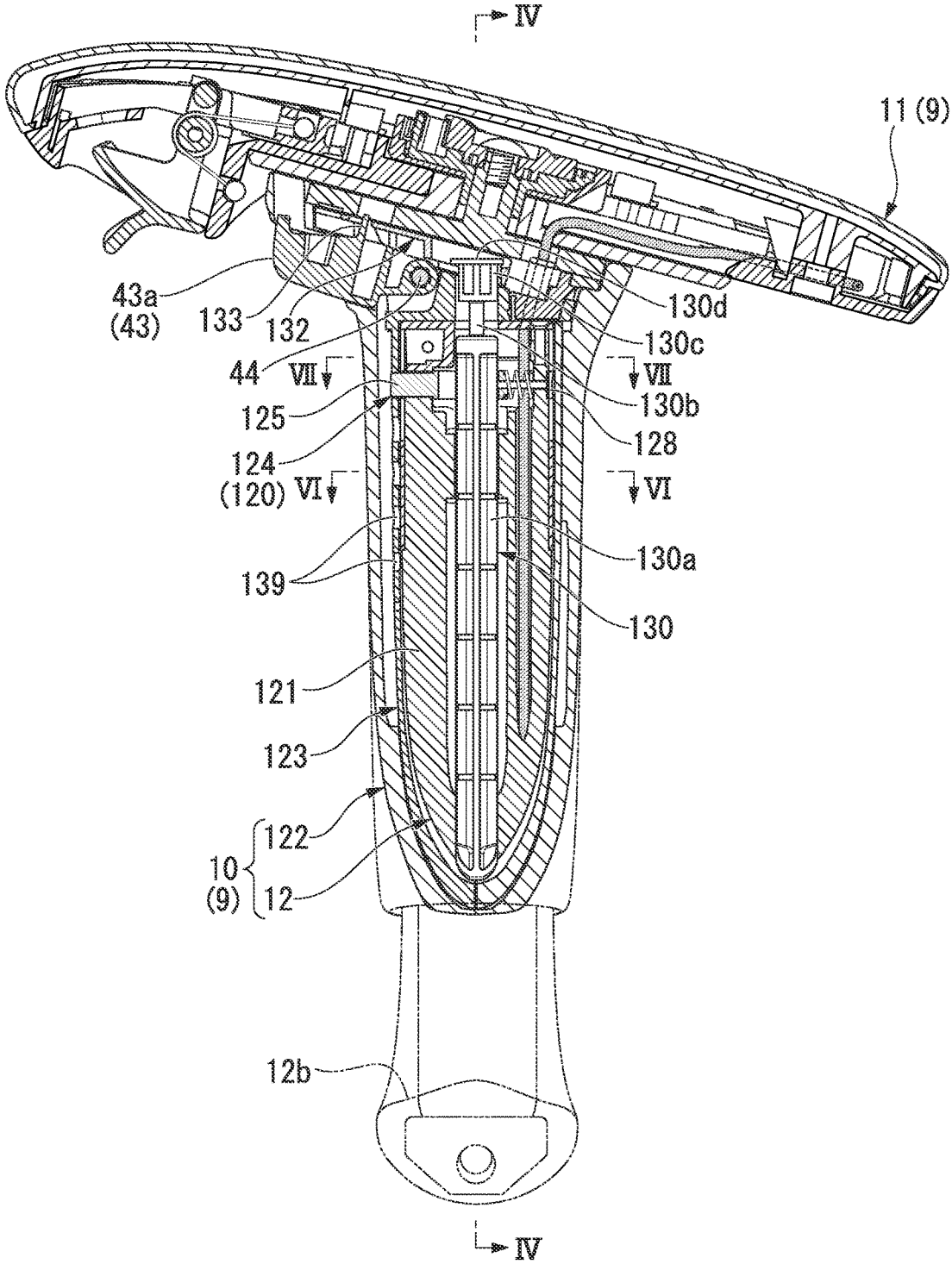
FIG. 17 is an enlarged vertical cross-sectional side view when an armrest post of an armrest device in a second embodiment of the present invention is cut by a vertical plane including its central axis.
Figure 18:
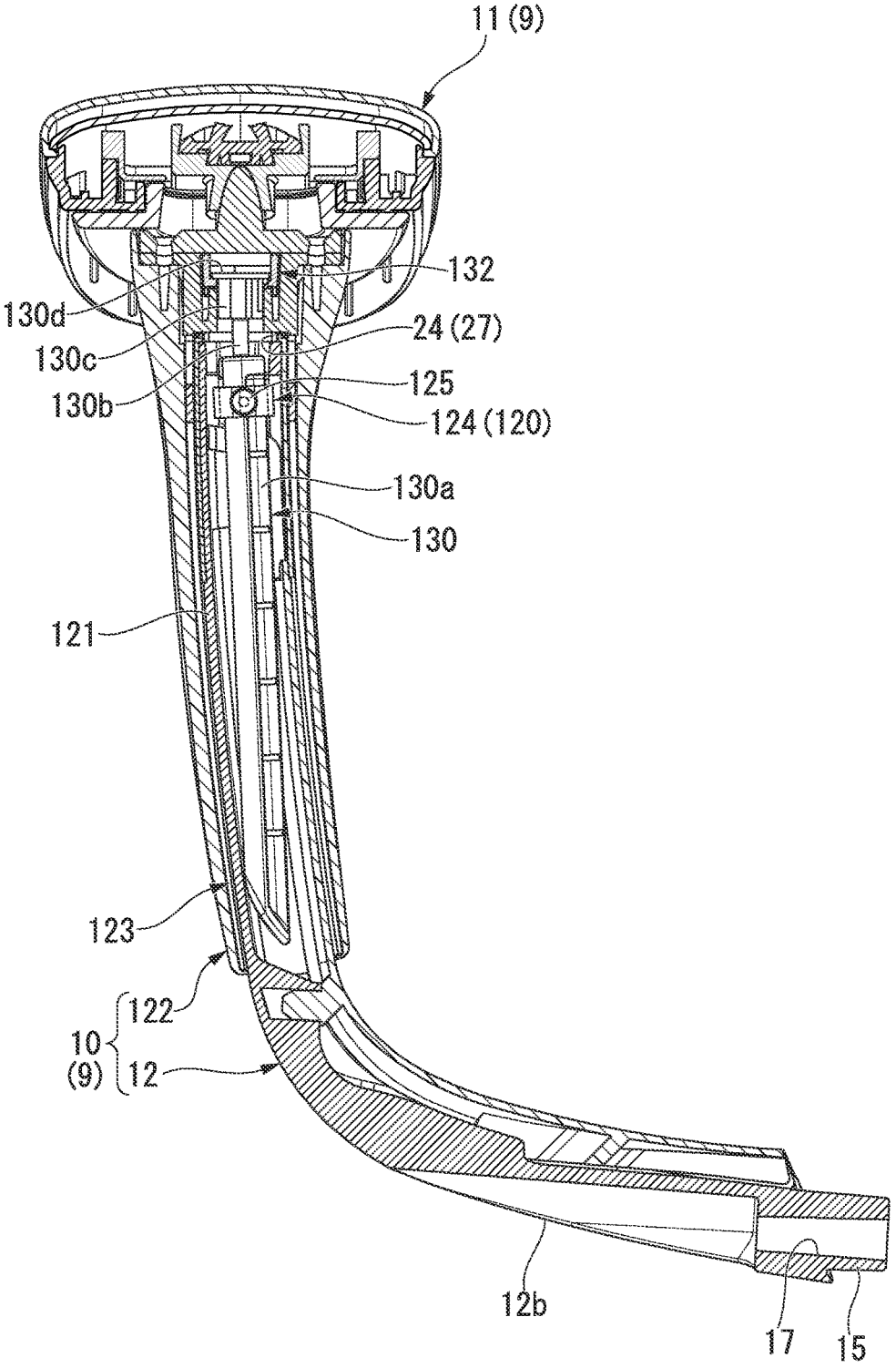
FIG. 18 is a cross-sectional view taken along line IV-IV of FIG. 17.
Figure 22:
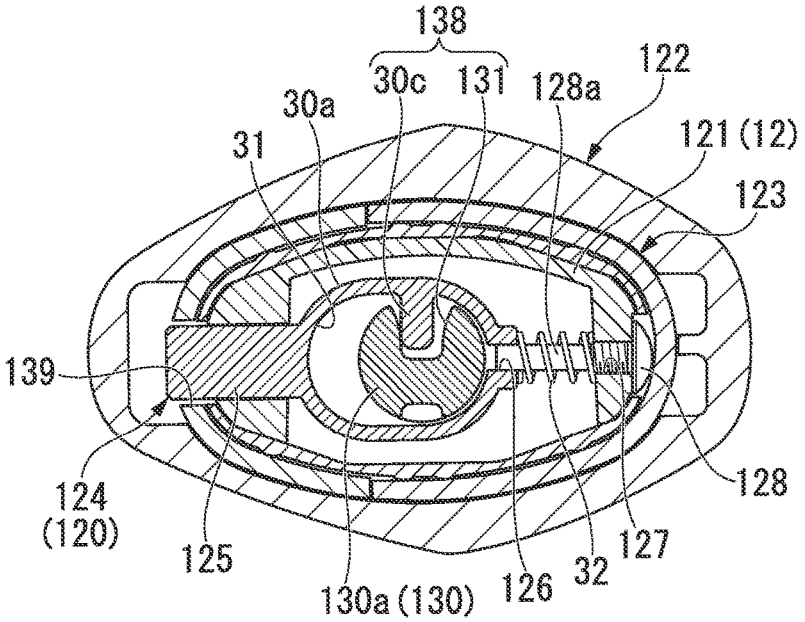
FIG. 22 is a cross-sectional view taken along line IV-IV of FIG. 17 before the operating lever in the second embodiment of the present invention is operated.

As shown in FIGS. 17, 18, and 22, in the present embodiment, a locking member 124 is provided instead of the locking member 30 of the first embodiment. The locking member 124 has a columnar engaging protrusion (locking pin) 125 at a front end of the trunk portion 30*a*, and has a pin hole 126, which is coaxial with the engaging protrusion 125 and opens rearward, in the rear surface of the trunk portion 30*a*. A screw hole 127 coaxial with the pin hole 126 is formed in a rear wall of the rising portion 121 behind the pin hole 126. A journaling screw 128 having a columnar tip shank 128*a* is screwed and fixed to the screw hole 127. The tip shank 128*a* is rotatably and slidably in the frontward-rearward direction inserted into the pin hole 126 of the trunk portion 30*a*. The locking member 124 is tiltable to the left and right with the tip shank 128*a* and the engaging protrusion 125 as an axis.

Additionally, in the present embodiment, a rotating rod 130 (actuating member) is provided instead of the rotating rod 40 of the first embodiment. The rotating rod 130 coaxially, linearly, and integrally has a shank 130*a* inserted into the inner cylinder 123, a small-diameter shank 130*b* connected to an upper portion of the shank 130*a* so as to be reduced in diameter in the shape of a step, and an operated portion 130*c* connected to an upper portion of the shank 130*b* so as to be increased in diameter in the shape of a step. The shank 130*a* is appropriately subjected to thinning so as to leave a longitudinal rib along an axial direction and a transverse rib orthogonal to the longitudinal rib, at an outer periphery thereof, and a recessed groove 131 (action portion) along the axial direction is formed at an outer periphery of a left-right outer side (the same side as the protrusion 30*c* of the locking member 124) over the total length of the shank. When the shank 130*a* is inserted through the trunk portion 30*a* of the locking member 124, the protrusion 30*c* fits into the recessed groove 131 so as to be slidable up and down.

Figure 20:
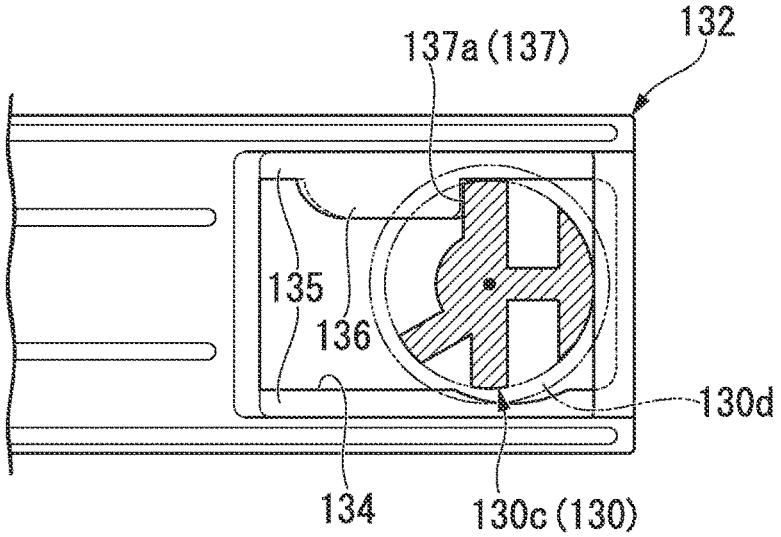
FIG. 20 is a cross-sectional view taken along line IV-IV of FIG. 17 before an operating lever in the second embodiment of the present invention is operated.

As shown in FIGS. 17 and 20, a slider 132 that is slidable back and forth is arranged at an upper end portion of the inner cylinder 123. The slider 132 has an upper locking piece 133 of the operating lever 43 engaged with a front end portion thereof. The upper locking piece 133 moves the slider 132 rearward when the operating portion 43*a* of the operating lever 43 is pushed upward.

A rear portion of the slider 132 is formed with an engaging hole 134 which forms a rectangle in a plan view and through which the rotating rod 130 is inserted from above. Inner flanges 135 are formed on both sides of the engaging hole 134, and a flange 130*d* formed at an upper end of the operated portion 130*c* of the rotating rod 130 comes into sliding contact with the inner flanges 135 from above. The slider 132 is held within the upper support cylinder 122 with the inner cylinder 123 in a state where the rotating rod 130 is inserted through the engaging hole 134 and is hung within the inner cylinder 123.

The upper support cylinder 122 is mounted on the rising portion 121 of the lower support rod 12 in a state where the slider 132, the inner cylinder 123, and the rotating rod 130 are held. In this case, the shank 130*a* of the rotating rod 130 is inserted through the trunk portion 30*a* of the locking member 124, and the protrusion 30*c* fits into the recessed groove 131 in a relatively movable manner (refer to FIG. 22). The rotating rod 130 is integrally liftable with respect to the lower support rod 12 together with the slider 132, the inner cylinder 123, and the upper support cylinder 122, and is a little tiltable with respect to the slider 132 or the like.

As shown in FIG. 20, a protruding piece 136 that protrudes to the inside of the engaging hole 134 is formed on the inner flange 135 on the left-right outer side of the engaging hole 134. Meanwhile, an outer periphery of the operated portion 130*c* of the rotating rod 130 is formed with a cutout portion 137 including an abutting surface 137*a* formed to be substantially orthogonal to a circumferential direction at almost the same circumferential position as the recessed groove 131. A rear end of the protruding piece 136 of the engaging hole 134 is engaged with an eccentric portion of the abutting surface 137*a* of the cutout portion 137 from the front when the engaging hole 134 is inserted through the engaging hole 134.

Figure 21:
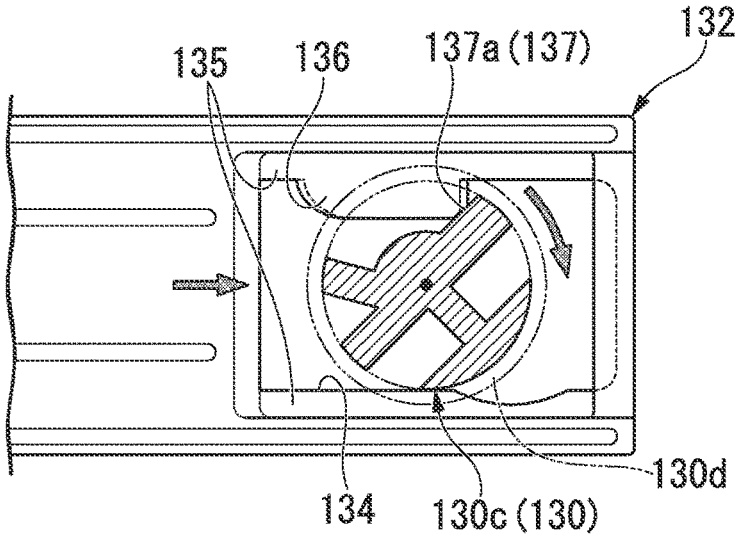
FIG. 21 is a cross-sectional view when the operating lever is operated with respect to FIG. 20.

In this state, when the slider 132 is moved rearward by the operation of the operating lever 43, the protruding piece 136 presses the eccentric portion of the abutting surface 137*a* rearward, and as shown in FIG. 21, the rotating rod 130 is rotated clockwise in the drawing.

Figure 23:
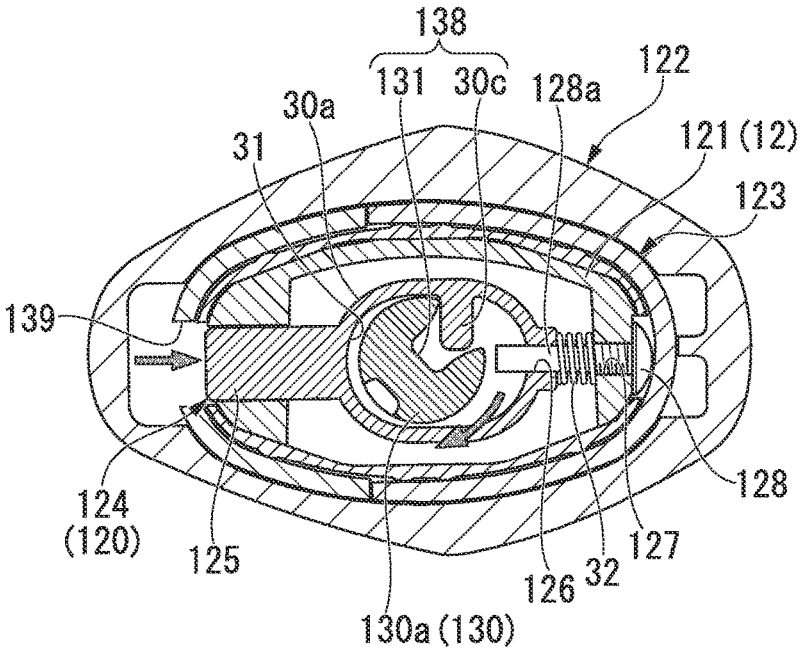
FIG. 23 is a cross-sectional view when the operating lever is operated with respect to FIG. 22.

As shown in FIG. 23, when the rotating rod 130 is rotated clockwise, the locking member 124 is moved rearward against the biasing force of the compression coil spring 32 via the interlocking mechanism 138 including the recessed groove 131 and the protrusion 30*c*.

As shown in FIG. 22, the locking member 124 is biased forward by the biasing force of the compression coil spring 32 during non-operation of the operating lever 43. Accordingly, the locking member 124 is brought into the locking position where the engaging protrusion 125 is engaged with any one of the plurality of circular engaging holes 139 (engaging portions) provided vertically side by side on the front surface of the inner cylinder 123. In this case, the inner cylinder 123, the upper support cylinder 122, and the armrest 11 are held at appropriate heights.

When the height of the armrest 11 is changed from this state, the operating portion 43*a* of the operating lever 43 is pushed upward in any case of lifting and lowering. Then, as shown in FIG. 23, the slider 132 is moved rearward to rotate the rotating rod 130 clockwise and to move the locking member 124 rearward against the biasing force of the compression coil spring 32. Accordingly, the locking member 124 is brought into the unlocking position where the engaging protrusion 125 is disengaged from the engaging hole 139, and the inner cylinder 123, the upper support cylinder 122, and the armrest 11 are made liftable.

If a hand is left from the operating lever 43 after the operating lever 43 is operated to move the armrest 11 to a desired height, the locking member 124 is moved forward by the biasing force of the compression coil spring 32, and is returned to the locking position where the engaging protrusion 125 is engaged with any one engaging hole 139 of the inner cylinder 123. Even if the tip of the engaging protrusion 125 abuts against the inner surface of the inner cylinder 123 and stops while avoiding the engaging holes 139, the engaging protrusion 125 is engaged with the nearest engaging hole 139 and brought into the locking position, simply by slightly moving the armrest 11 either upward or downward.

If the engaging protrusion 125 of the locking member 124 is engaged with any one engaging hole 139 of the inner cylinder 123 and the locking member 124 stops at the locking position, the inner cylinder 123, and the upper support cylinder 122 and the armrest 11 integral with the inner cylinder 123 are held at predetermined heights at that time.

Figure 19:
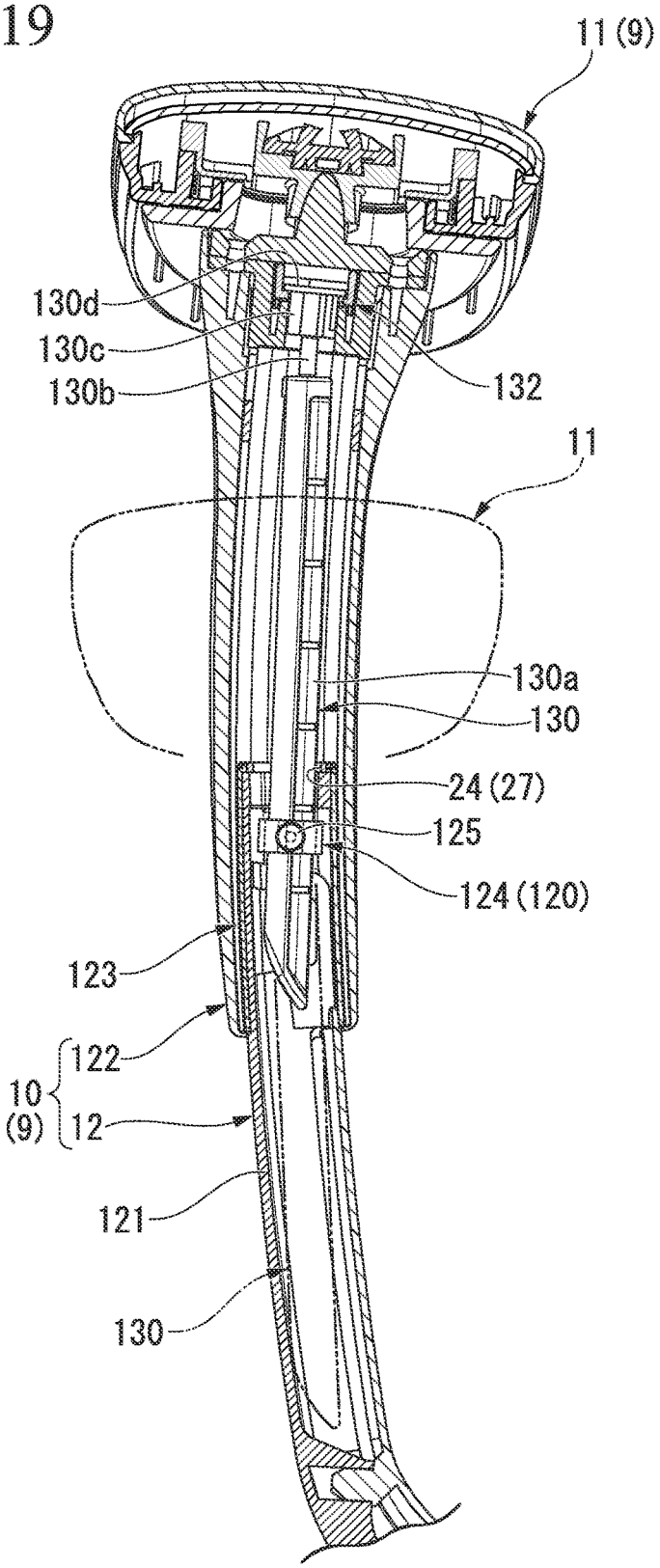
FIG. 19 is a cross-sectional view when the armrest is raised with respect to FIG. 17.

Here, as shown in FIG. 19, when the armrest 11 is lifted and lowered, the rising portion 121 of the lower support rod 12, the upper support cylinder 122, and the inner cylinder 123 form a curved shape in the cross-sectional view in the frontward-rearward direction. Therefore, the lifting and lowering track of the inner cylinder 123, the upper support cylinder 122, and the armrest 11 also forms the same curved shape in the cross-sectional view in the frontward-rearward direction.

In this case, although the rotating rod 130 lifted and lowered together with the inner cylinder 123 is also lifted and lowered in a curved shape, the locking member 124 through which the rotating rod 130 is inserted is held by the upper end portion of the rising portion 121 so as to be tiltable left and right. Accordingly, even if an angle is changed in the cross-sectional view in the frontward-rearward direction with respect to the lower support rod 12 while the rotating rod 130 makes the recessed groove 131 and the protrusion 30*c* slide with the lifting and lowering thereof, the locking member 124 is appropriately tilted in accordance with this, whereby the engagement relationship between the rotating rod 130 and the locking member 124 is kept constant irrespective of the height of the armrest 11. In addition, the armrest 11 and the rotating rod 130 shown by chain lines in the drawing show a state (state equivalent to FIG. 18) where the armrest and the rotating rod have been lowered.

Since the rotating rod 130 is arranged so as to run along a chord of the curved lifting and lowering track of the armrest 11 or the like in the cross-sectional view in the frontward-rearward direction, the angle with respect to the upper support cylinder 122 or the like also changes. Since the upper end portion of the rotating rod 130 is tiltable left and right even with respect to the upper support cylinder 122 or the like, the engagement relationship between the rotating rod 130 and the slider 132 is also kept equal irrespective of the height of the armrest 11. In the present embodiment, the insertion hole 24 for the rotating rod 130 of the end cap 27 mounted on the upper end portion of the rising portion 121 forms an oval shape that is elongated in left-right direction above the locking member 124, and the left-right tilt of the rotating rod 130 is permitted.

In the height adjustment device 120 of the present embodiment, similar to the first embodiment, the relative relationship among the rotating rod 130, the locking member 124, and the interlocking mechanism 138 is substantially constant irrespective of the height of the armrest 11. Even if the armrest 11 is at any height, a light unlocking operation can be performed under the same conditions, and the possibility of erroneous operation or malfunction can be reduced.

In the height adjustment device 120 of the present embodiment, the locking member 124 is tiltably supported on the lower support rod 12. Accordingly, even when the upper support cylinder 122 or the rising portion 121 of the lower support rod 12 is curved, and the rotating rod 130 is lifted and lowered in the curved track, the engagement relationship between the recessed groove 131 of the rotating rod 130 and the protrusion 30*c* of the locking member 124 can be kept equal irrespective of the up-down position of the upper support cylinder 122 or the rotating rod 130, and the interlocking operation of these can be kept excellent. That is, the operation using the operating lever 43 provided in the armrest 11 can be smoothly and reliably performed irrespective of the up-down position of the armrest 11.

Next, FIGS. 24 to 27 show, a modification example of the second embodiment of the height adjustment device. A height adjustment device 140 of this modification example is different from that of the second embodiment particularly in that this height adjustment device includes an actuating member 150 instead of the rotating rod 130 of the second embodiment. In addition, although there are portions having different shapes or the like, the same components as those of the second embodiment will be designated by the same reference numerals, and a detailed description thereof will be omitted here.

Figure 24:
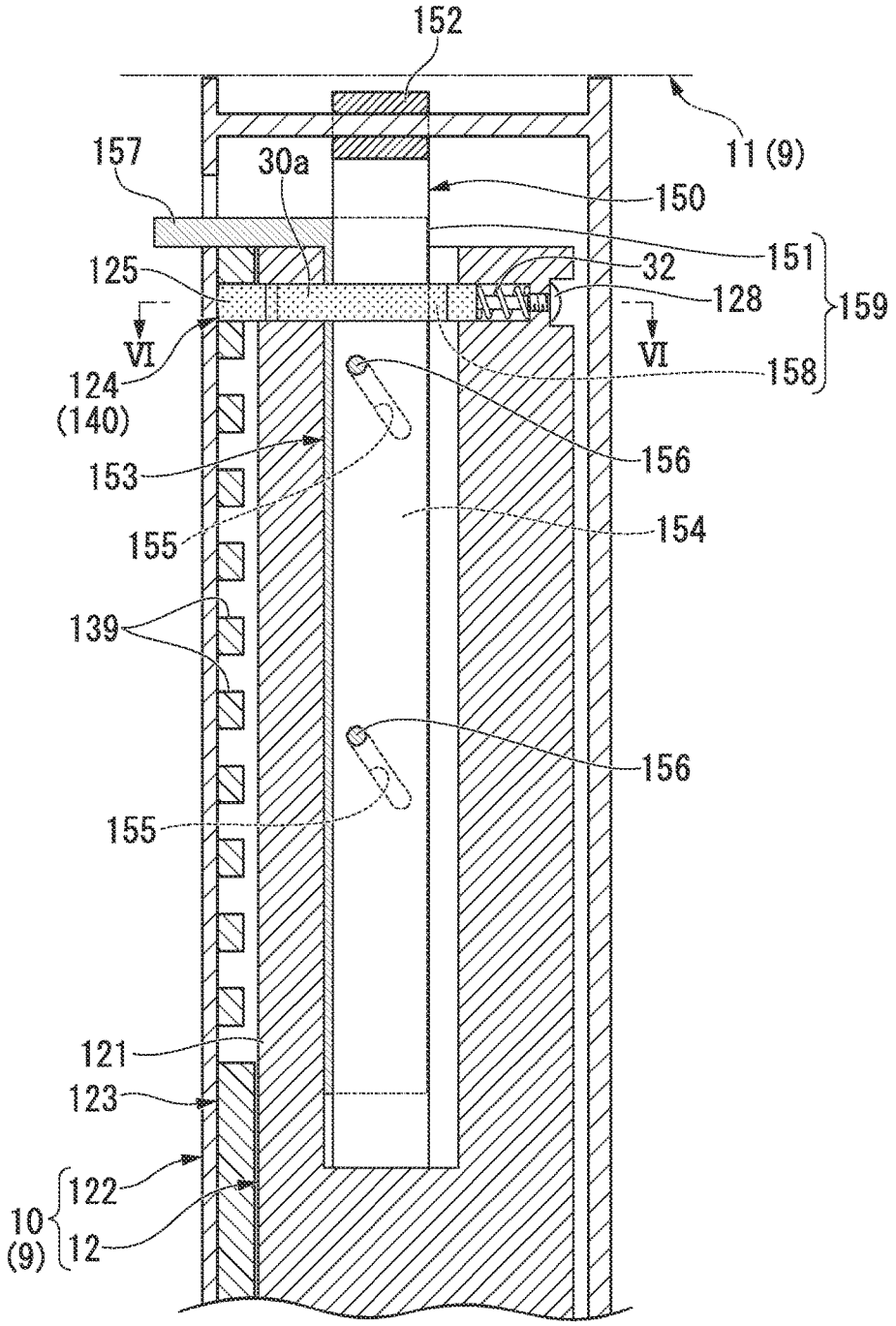
FIG. 24 is an enlarged vertical cross-sectional side view when the armrest post of the armrest device before the operating lever is operated in a modification example of the height adjustment device is cut by a vertical plane including its central axis.
Figure 25:
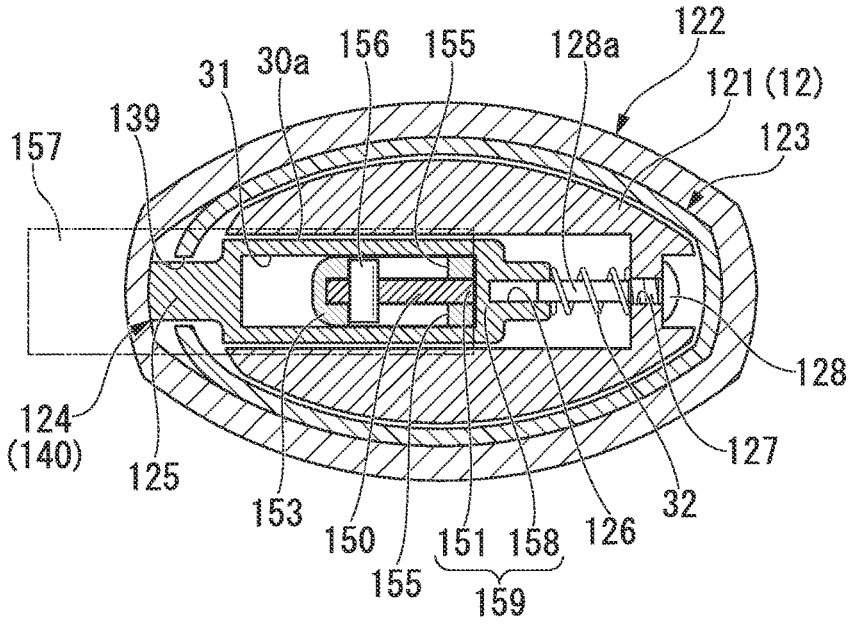
FIG. 25 is a cross-sectional view taken along line IV-IV of FIG. 24.

As shown in FIGS. 24 and 25, the actuating member 150 is supported on the upper support cylinder 122 together with a relay member 153, and is movable in the up-down direction with respect to the lower support rod 12 and the locking member 124 together with the relay member 153, the upper support cylinder 122, and the inner cylinder 123. The actuating member 150 keeps an action portion (rear edge portion 151), which is elongated frontward-rearward with respect to the locking member 124, engaged with the actuating member 150 even if the actuating member 150 is moved in the up-down direction, and makes the locking member 124 movable in a direction (rearward) of the unlocking position even at any up-down position.

The actuating member 150 forms a band plate shape extending up and down, and is arranged so as to be substantially orthogonal to the left-right direction. An upper end portion 152 of the actuating member 150 is supported on an upper end portion of the upper support cylinder 122 so as to be movable in the frontward-rearward direction. The actuating member 150 is permitted only to translate in the frontward-rearward direction and tilt left and right with respect to the upper support cylinder 122.

A lower portion of the actuating member 150 is inserted into the trunk portion 30*a* of the locking member 124 together with the relay member 153 that operates in an interlocking manner with the operating lever 43. The relay member 153 has a U-shaped cross-sectional shape that opens rearward, extends up and down, and slidably sandwiches the lower portion of the actuating member 150 therein. The relay member 153 is permitted only to translate in the up-down direction and tilt integrally with the actuating member 150, with respect to the upper support cylinder 122.

Left and right side wall portions 154 of the relay member 153 are formed with a plurality of (two upper and lower stages in the drawings) rearward inclined slit holes 155. Both side portions of a locking pin 156 fixed to the actuating member 150 are engaged with the respective slit holes 155, respectively. In this state, the relay member 153 and the actuating member 150 are inserted into the trunk portion 30*a* of the locking member 124.

Figure 26:
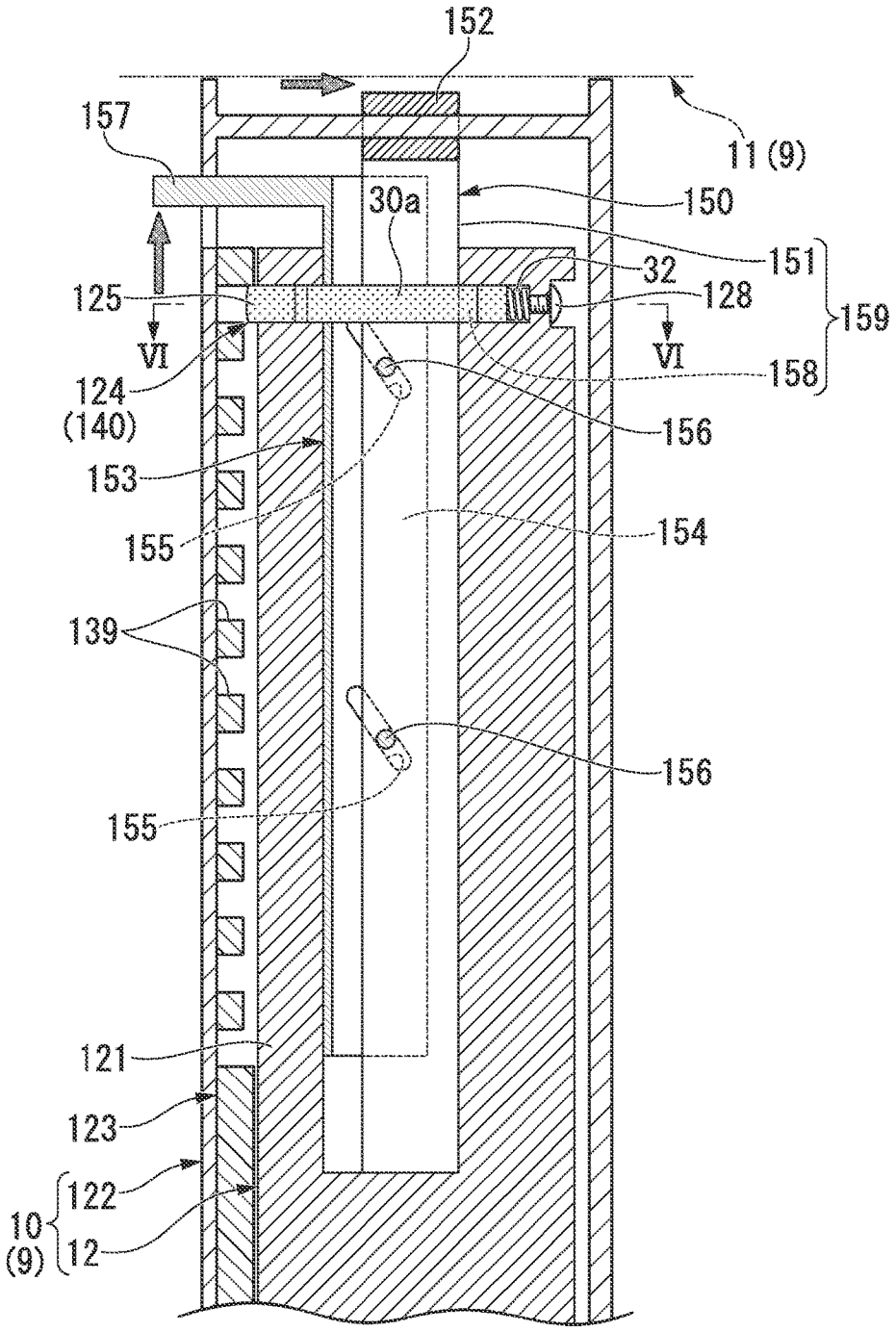
FIG. 26 is a cross-sectional view when the operating lever is operated with respect to FIG. 24.
Figure 27:
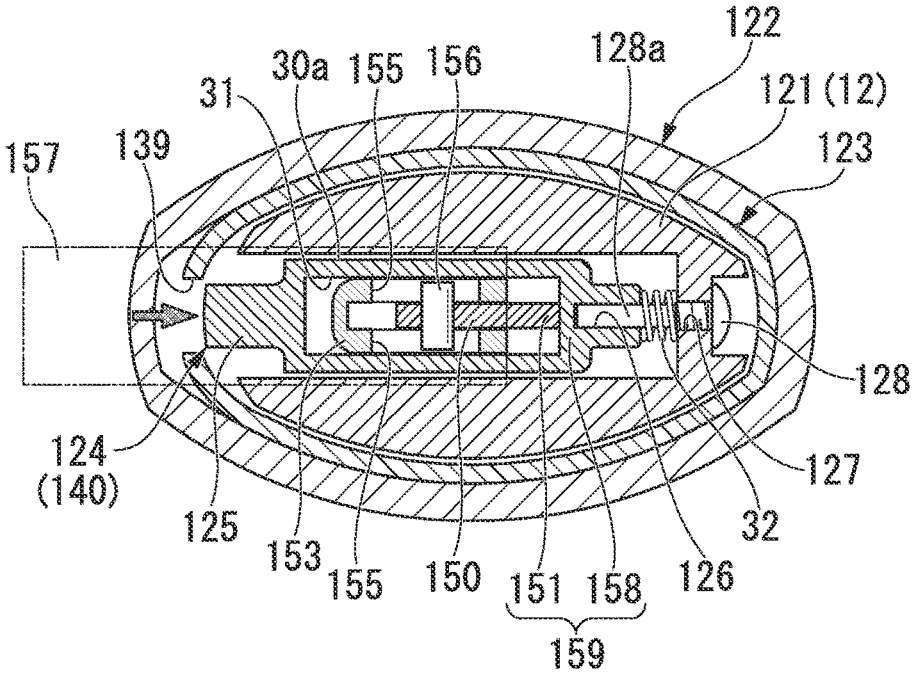
FIG. 27 is a cross-sectional view taken along line IV-IV of FIG. 26.

As shown in FIGS. 26 and 27, an upward force is input to an upper end protruding piece 157 of the relay member 153 by the operation of the operating lever 43. Accordingly, if the relay member 153 is lifted, the locking pin 156 and the actuating member 150 move rearward along the respective slit holes 155. A rear edge portion 151 of the actuating member 150 is engaged with the rear wall portion 158 of the trunk portion 30*a* of the locking member 124 from the front so as to be slidable up and down. The actuating member 150 and the locking member 124 operate in an interlocking manner via an interlocking mechanism 159 including the rear edge portion 151 and the rear wall portion 158.

That is, the locking member 124 is brought into the locking position by the biasing force of the compression coil spring 32 during non-operation of the operating lever 43 (refer to FIG. 25). If the operating lever 43 is operated from this state, the locking member 124 is moved rearward against the biasing force together with the actuating member 150 by the operation of the relay member 153, and is brought into the unlocking position.

In addition, the height adjustment device 140 may have a configuration using the rising portion 12*a*, the upper support cylinder 14, the inner cylinder 34, and the locking member 30 in the height adjustment device 13 of the first embodiment.

In the above respective embodiments, the height adjustment device 13, 120, and 140 are enabled to adjust the height of the armrest 11 of the armrest device 9 of the chair with respect to the lower support rod 12. However, the invention is not limited to this, and can be widely applied as a height adjustment device for the movable member that is made movable in the up-down direction with respect to the support in general fixtures.

Although the rising portion 121, the upper support cylinder 122, and the inner cylinder 123 that form a curved shape in the cross-sectional view in the frontward-rearward direction are shown in the second embodiment, these may be curved in the cross-sectional view in the left-right direction.

The invention is not limited only to the above respective embodiments, and can be carried out, for example, in many modified aspects as follows without departing from the scope of the invention.

(1) A protruding strip extending in the up-down direction is provided on an outer peripheral surface of the shank 40*a* or 130*a* of the rotating rod 40 or 130, the protruding strip fits into a recessed strip, which is provided in the inner surface of the insertion hole 31 of the locking member 30 or 124 and extends in the up-down direction, in a relatively movable manner, one side surface of the recessed strip is pushed by the protruding strip through the rotation of the rotating rod 40 or 130, and the locking member 30 or 124 moves from the locking position to the unlocking position.

(2) The operating lever 43 is formed in the shape of a pin that appears and disappears in the frontward-rearward direction from the front surface of the upper support cylinder 14 or 122, and the eccentric portion of the forwardly directed abutting surface 40*d* or 137*a* in the rotating rod 40 or 130 is pushed by a rear end of the pin to rotate the rotating rod 40 or 130 in a desired direction.

(3) The rear end portion of the pin and the upper end portion of the rotating rod 40 or 130 in the above (2) are coupled together by a link directed to a direction orthogonal to the rotating rod 40 or 130.

(4) The inner cylinder (guide member) 34 or 123 is not provided, and an engaging portion is directly provided at the inner wall of the upper support cylinder (movable member) 14 or 122 instead of the engaging hole 39 or 139. It is more preferable that the engaging portion in this case have a concavo-convex shape or the like that is not exposed to the outside rather than a through-hole or the like exposed to the outside.

INDUSTRIAL APPLICABILITY

In general fixtures, such as a chair, there is provided a height adjustment device in a fixture and an armrest device for a chair provided with the height adjustment device aimed at keeping the plurality of engaging portions from being exposed to the outside even if the movement stroke of the movable member is made large, making an operation smooth using the operating lever provided at the movable member irrespective of the up-down position or lifting and lowering track of the movable member, always lightly performing locking and unlocking operations in the same manner irrespective of the up-down position of the movable member, and having little possibility of erroneous operation or malfunction.

REFERENCE SIGNS LIST

9: ARMREST DEVICE
11, 91: ARMREST
12: LOWER SUPPORT ROD (SUPPORT)
12*a*, 121: RISING PORTION (SUPPORT)
13, 120, 140: HEIGHT ADJUSTMENT DEVICE
14, 122: UPPER SUPPORT CYLINDER (MOVABLE MEMBER)
30, 124: LOCKING MEMBER
30*b*, 125: ENGAGING PROTRUSION
30*c*: PROTRUSION

31: INSERTION HOLE
32: COMPRESSION COIL SPRING (BIASING MEMBER)
34, 123: INNER CYLINDER (GUIDE MEMBER)
39, 139: ENGAGING HOLE (ENGAGING PORTION)
40, 130: ROTATING ROD (ACTUATING MEMBER)
150: ACTUATING MEMBER
40*d*, 137*a:* ABUTTING SURFACE
41, 131: RECESSED GROOVE (ACTION PORTION)
151: REAR EDGE PORTION (ACTION PORTION)
42,138: INTERLOCKING MECHANISM
43: OPERATING LEVER (OPERATING MEMBER)

The invention claimed is:

1. A height adjustment device in a fixture comprising:
a support;
a movable member that is mounted on the support so as to be movable in an up-down direction, has a plurality of engaging portions arranged side by side in the up-down direction therein, and extends in the up-down direction;
a locking member that is provided at the support so as to be movable in a horizontal direction and immovable in the up-down direction to a locking position where the locking member is selectively engaged with any one engaging portion of the movable member and to an unlocking position where the locking member is disengaged from the engaging portion;
a biasing member that is provided at the support and biases the locking member toward the locking position;
an actuating member that is provided at the movable member, is made movable in the up-down direction with respect to the support and the locking member together with the movable member, keeps an action portion, which is slidable up and down with respect to the locking member, engaged with the locking member even if being moved in the up-down direction, and makes the locking member movable in a direction of the unlocking position at any up-down position; and
an operating member that is provided at the movable member and actuates the actuating member so as to move the locking member in the direction of the unlocking position via the actuating member.

2. The height adjustment device in a fixture according to claim 1 further comprising:
a guide member that is fixed inside the movable member, has the plurality of engaging portions, and extends in the up-down direction.

3. The height adjustment device in a fixture according to claim 2,
wherein the guide member has a plurality of engaging holes as the plurality of engaging portions.

4. The height adjustment device in a fixture according to claim 1 wherein the locking member is tiltably supported on the support.

5. The height adjustment device in a fixture according to claim 4,
wherein the locking member tilts around an axis of an engaging protrusion provided to protrude so as to be engaged with the engaging portion.

6. A height adjustment device in a fixture comprising:
a support;
a movable member that is mounted on the support so as to be movable in an up-down direction, has a plurality of engaging portions arranged side by side in the up-down direction, and extends in the up-down direction;
a locking member that is provided in the support so as to be movable in a horizontal direction and immovable in the up-down direction to a locking position where the locking member is selectively engaged with any one engaging portion of the movable member and to an unlocking position where the locking member is disengaged from the engaging portion;
a biasing member that is provided in the support and biases the locking member toward the locking position;
a rotating rod that is parallel to the movable member, is mounted on the movable member so as to be rotatable around an axis extending in the up-down direction, and is movable in the up-down direction together with the movable member with respect to the support and the locking member;
an interlocking mechanism that interlocks the rotating rod and the locking member so that the locking member is moved in a direction of the unlocking position by the rotation of the rotating rod in one direction; and
an operating lever that is provided in the movable member and rotates the rotating rod around the axis extending in the up-down direction.

7. The height adjustment device in a fixture according to claim 6,
wherein the rotating rod is rotatably inserted through an insertion hole provided in the locking member and directed to the up-down direction,
wherein the interlocking mechanism includes a protrusion that is provided so as to protrude from an inner surface of the insertion hole of the locking member, and a recessed groove that is provided in an outer peripheral surface of the rotating rod, has the protrusion fitted thereinto in a relatively movable manner, and is directed to the up-down direction, and
wherein the rotating rod is rotated in one direction around the axis, and thereby the protrusion is pushed by an actuating portion formed on one side surface of the recessed groove, and the locking member is moved toward the unlocking position.

8. The height adjustment device in a fixture according to claim 6,
wherein an abutting surface parallel to a central axis of the rotating rod is formed in portion of the rotating rod, and the rotating rod is rotated by pushing an eccentric portion of the abutting surface with one end portion of the operating lever provided at the movable member.

* * * * *